US008444241B2

(12) United States Patent
Terakado et al.

(10) Patent No.: US 8,444,241 B2
(45) Date of Patent: May 21, 2013

(54) INKJET PRINTER

(75) Inventors: Ryo Terakado, Ibaraki-ken (JP); Masato Hirai, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 352 days.

(21) Appl. No.: 12/770,817

(22) Filed: Apr. 30, 2010

(65) Prior Publication Data

US 2010/0283808 A1 Nov. 11, 2010

(30) Foreign Application Priority Data

May 7, 2009 (JP) ..... P2009-112947
Jun. 19, 2009 (JP) ..... P2009-146270
Mar. 30, 2010 (JP) ..... P2010-078489

(51) Int. Cl.
*B41J 29/38* (2006.01)
*B41J 2/18* (2006.01)

(52) U.S. Cl.
USPC ..... 347/6; 347/89

(58) Field of Classification Search
None
See application file for complete search history.

(56) References Cited

U.S. PATENT DOCUMENTS

2008/0284809 A1* 11/2008 Okawa ..... 347/17

FOREIGN PATENT DOCUMENTS

JP 09-029996 A 2/1997
JP 2008-023806 A 2/2008
JP 2008-037020 A 2/2008

* cited by examiner

*Primary Examiner* — Geoffrey Mruk
(74) *Attorney, Agent, or Firm* — Nath, Goldberg & Meyer; Jerald L. Meyer; Scott Langford

(57) ABSTRACT

A print head includes an ink chamber for storing ink therein, an ink propelling mechanism for propelling ink out of the ink chamber, and a temperature sensor for measuring an ink temperature in the ink chamber, an ink circulation route has a route including the ink chamber, and a print controller works at least along deactivation of an energy saving mode or upon power-on, in response to the temperature sensor having a measure of ink temperature lower than a prescribed value, for a pre-treatment to have the ink propelling mechanism make ink vibrating actions within degrees not to cause ink to be propelled out of the ink chamber, until the ink temperature becomes the prescribed value or more.

10 Claims, 20 Drawing Sheets

INKJET PRINTER

CROSS REFERENCE TO RELATED APPLICATIONS

The present application claims the benefits of priorities under 35 U.S.C. §119 to Japanese Patent Application Nos. 2009-112947, 2009-146270, and 2010-78489 filed on May 7, 2009, Jun. 19, 2009, and Mar. 30, 2010, respectively, the entire contents of which are incorporated herein by reference.

BACKGROUND OF THE INVENTION

1. Field of Art

The present invention relates to an inkjet printer including a print head for propelling ink droplets to make a print, addressing techniques for adaptation to reduce a time for transition of ink state to an optimal temperature state, such as those from a low temperature state upon a power-on or in a return from energy saving mode.

2. Description of Relevant Art

There has been spread use of inkjet printers including print heads for propelling ink droplets to make a print on a print sheet. In inkjet printers, print heads have had their ink propelling mechanisms configured with arrays of piezoelectric devices or such for propelling ink droplets in accordance with applied drive voltages. For use in inkjet printers, there have been various kinds of ink available with a typical property tending to have increased viscosities under low-temperature environments, constituting a difficulty to secure adequate droplet amounts. To this point, there has been a patent literature 1 (Japanese Patent Application Laid-Open Publication No. 2008-23806) disclosing an inkjet printer adapted for warm-up of ink in a low temperature state, with a pause of print until an arrival at an adequate ink temperature.

Further, there has been a patent literature 2 (Japanese Patent Application Laid-Open Publication No. 2008-37020) disclosing an inkjet printer including an ink temperature adjusting mechanism configured for a temperature control of ink circulating along an ink circulation route, to suppress consumption of power for ink warm-up, and adapted for a prompt arrival at a prescribed ink temperature to be held, to reduce a waiting time before a recording process.

In addition, there has been a patent literature 3 (Japanese Patent Application Laid-Open Publication No. 9-299) disclosing an inkjet printing method adapted for a constant delivery to be stable even in use of ink with a tendency to exhibit a significant increase in viscosity due to evaporation of volatile ingredients of ink, affording to suppress waste consumption of ink.

SUMMARY OF THE INVENTION

There has been a promoted energy saving of electronics in recent years, giving rise to generalization of inkjet printers provided with an energy saving mode. Provided with an energy saving mode, inkjet printers have been adapted to work, in a continuous waiting exceeding a prescribed time interval or upon reception of a shift command from user, for a shift to enter the mode for an energy saving operation with reduced power consumption, and upon reception of a print job, to exit from the energy saving mode.

There has been use of energy saving modes for interrupting operations of, among others, a sheet feeding mechanism and a printing mechanism, while keeping alive a function or functions simply for accepting instructions from user or reception of print data to detect a received print job. For inkjet printers provided with such a circulation route of ink as disclosed in the patent literature 1, there has been a typical energy saving mode for interrupting ink circulation and ink temperature control, as well. Hence, there has been the need of a heater or the like for use after deactivation of energy saving mode, to warm up ink from a low temperature to an adequate ink temperature to start a printing.

As a result, there have been inkjet printers adapted for energy saving mode subject to an elongate interval between deactivation of the energy saving mode and a start of printing in low-temperature seasons, as an issue. In particular, in ink-circulating inkjet printers, there has been much ink to be warmed up, as the more significant issue.

In the patent literature 2, the inkjet printer disclosed has been provided with the ink temperature adjusting mechanism to implement a temperature control of ink circulating along an ink circulation route. However, such the ink circulation system has circulated a large amount of ink, of which an entirety has had a great heat capacity needing a significant time for warm-up of ink to a desirable ink temperature.

In environments having low ambient air temperatures, the inkjet printer might have had an ink temperature substantially equal to a surrounding air temperature, that is, it might have had a lower ink temperature than a lower end of a range of ink temperatures enabling use of ink. In such situations, there has been the need of waiting an ink temperature adjusted to start a printing.

For a quicker warm-up for the inkjet printer disclosed in the patent literature 2 to have a target ink temperature, the ink temperature adjusting mechanism has needed a whole-covering large heater installed inside, with an increased power consumption of the inkjet printer, as an issue.

The inkjet printer disclosed in the patent literature 2 has been adapted to detect a temperature of ink therein simply with a temperature detector in a vicinity of a nozzle army in an inkjet head, and unable to individually detect an ink temperature in the inkjet head and an ink temperature in an ink supply route or in an ink collection route, as another issue.

In the patent literature 3, the inkjet printing method disclosed has included driving piezoelectric devices to degrees not to cause ink droplets to be propelled out from nozzle openings in a non-propelling phase for ink not to be propelled out, for the purpose of simply preventing nozzles from being clogged with ink in use in a state of ink with a significant increase in viscosity due to evaporation of volatile ingredients in ink.

It is an object of the present invention to provide an inkjet printer with an ink circulation route allowing for a reduced time for transition of ink state to an optimal temperature state, such as those from a low temperature state upon a power-on or in a return from energy saving mode.

To achieve the object, according to a first aspect of the present invention, there is an inkjet printer comprising a print head configured with an ink chamber to store ink therein, an ink propelling mechanism to propel ink out of the ink chamber, and a temperature sensor to measure an ink temperature in the ink chamber, an ink circulation route configured with a route including the ink chamber, and a print controller configured to work at least along deactivation of an energy saving mode or upon power-on, in response to the temperature sensor having a measure of ink temperature lower than a prescribed value, for a pre-treatment to have the ink propelling mechanism make ink vibrating actions within degrees not to cause ink to be propelled out of the ink chamber, until the ink temperature becomes the prescribed value or more.

Further, to achieve the object, according to a second aspect of the present invention, there is an inkjet printer comprising a print head configured with an ink chamber to store ink therein, an ink propelling mechanism to propel ink out of the ink chamber, and a temperature sensor to measure an ink temperature in the ink chamber, an ink circulation route configured with a route including the ink chamber, an ink quantity analyzer configured to analyze a quantity of ink necessitated for a printing of an input print data, and a print controller configured to work at least along deactivation of an energy saving mode or upon power-on, in response to the ink quantity analyzer having analyzed an ink quantity as a prescribed value or less, for a pre-treatment to heat ink up to an applicable ink temperature as a measure of ink temperature at the temperature sensor.

DETAILED DESCRIPTION OF THE EMBODIMENTS

There will de described best modes of embodiment for carrying out the invention with reference to the accompanying drawings.

First Embodiment

Figure 1:
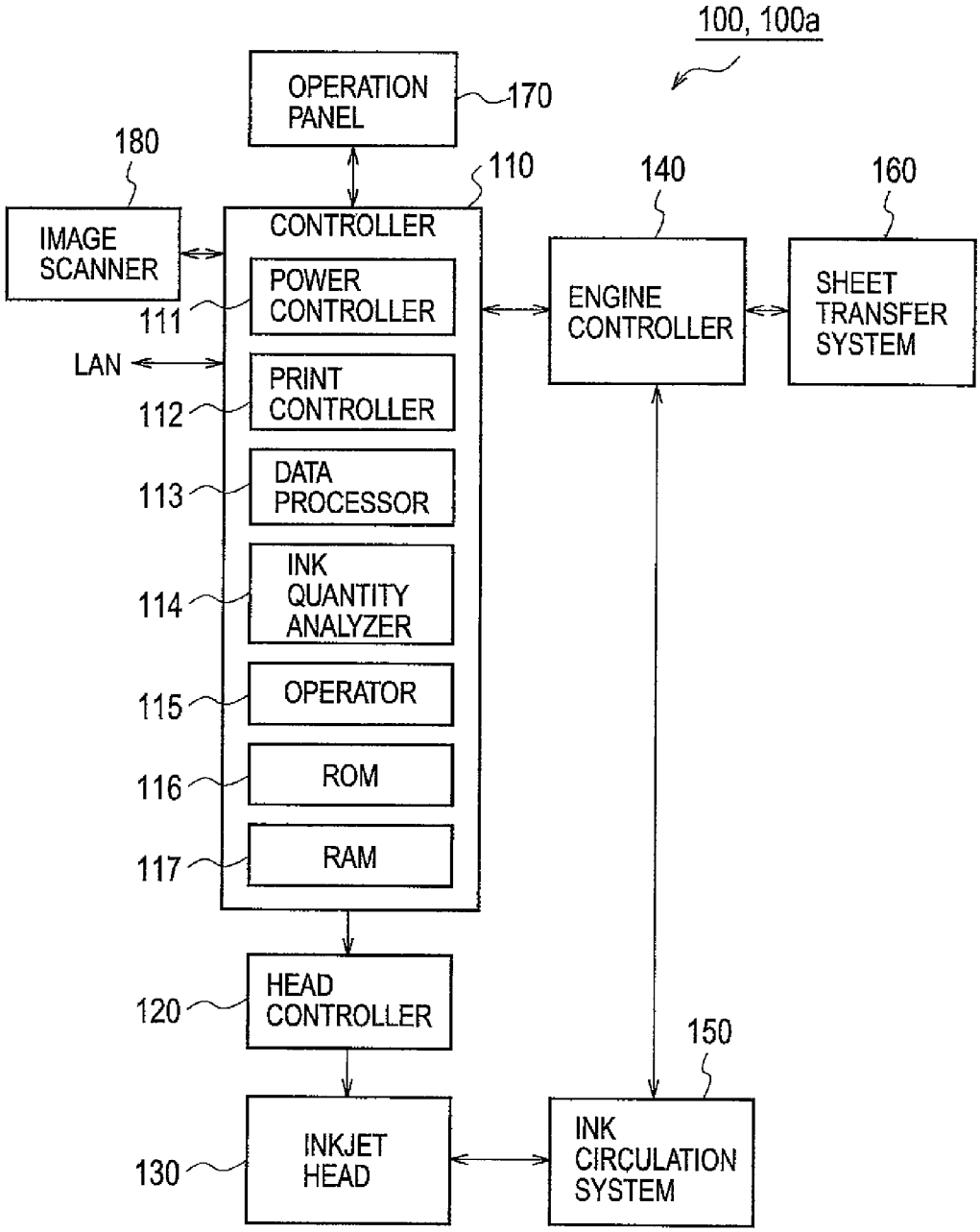
FIG. 1 is a block diagram of entire configuration of an inkjet printer according to a first embodiment of the present invention.

Description is now made of a first embodiment of the present invention, with reference to associated drawings. FIG. 1 is a block diagram of entire configuration of an inkjet printer 100 according to this embodiment. As shown in the figure, the inkjet printer 100 includes a controller 110, a head controller 120, an inkjet head 130, an engine controller 140, an ink circulation system 150, a sheet transfer system 160, an operation panel 170, and an image scanner 180.

The controller 110 includes, among others, a controller substrate provided with a CPU, memories, etc. for image processing, print job control, and the like. In other words, it implements a sequence of processes including a process of generating ink discharge data based on an image frame to be printed, to output to the head controller 120. The image frame to be printed may be a set of image data scanned by the image scanner 180, or a set of print data transmitted from a PC through a LAN.

More specifically, the controller 110 includes: a power controller 111 configured to control a shift to an energy saving mode of the inkjet printer 100 and a return from the energy saving mode; a print controller 112 configured to control a process of printing such as along a return from the energy saving mode or upon power-on of the printer 100; and a data processor 113 configured for temporary storage of and to process a set of print data transmitted from a PC through a LAN. It further includes: an ink quantity analyzer 114 configured to have information of a print job or print jobs pertaining to the set of print data, for analysis thereof to determine a quantity of ink necessitated for a printing of the print data set; an operator 115; a ROM 116 adapted for storage of programs such as a control program of the inkjet printer 100, and a RAM 117 adapted for temporary storage of data on variables associated with actions of the inkjet printer 100.

This embodiment has the data processor 113 and the ink quantity analyzer 114 both incorporated in the controller 110. However, there may be a data processor and/or an ink quantity analyzer adapted to be similar thereto in function, and separated from a controller, with interfaces in between for component-wise signal transmission and reception.

The head controller 120 is configured to generate a set of drive signals, to output to the inkjet head 130, for driving the inkjet head 130 in accordance with a set of ink discharge data input from the controller 110. The set of ink discharge data may be a set of data on ink droplet numbers per pixel in a cell or line of image, for instance.

The inkjet head 130 is configured with multiple nozzles, and has behind each of them an ink chamber to store ink therein, and an ink propelling mechanism to discharge or propel ink out of the ink chamber through the nozzle. In this embodiment, the ink propelling mechanism has a piezoelectric element employed for causing the ink chamber to change shape, to propel a droplet of ink through the nozzle. Hence, the ink propelling mechanism has, besides the piezoelectric element, a driver for driving the piezoelectric element in accordance with a signal output from the head controller 120. There may be use of an ink propelling mechanism with a heating element for heating ink, to produce bubbles, to eject ink.

The ink circulation system 150 includes an ink route of circulation type (referred herein to as an ink circulation route IC1), a pump, a heater, a cooler, a temperature sensor or thermometer, etc. In the ink circulation system 150, ink is circulated along the ink route, and supplied to ink chambers in the inkjet head 130. For the inkjet printer 100, provision of the ink circulation system 150 permits an effective removal of impurities in ink. The sheet transfer system 160 includes, among others, feed and discharge mechanisms, and drives such as motors and rollers for sheet feed, transfer, and discharge.

The engine controller 140 is configured to control the ink circulation system 150 and the sheet transfer system 160. Specifically, it controls active elements in the ink circulation system including heater, cooler, pump, temperature sensor or thermometer, to execute necessary processes for ink circulation, ink temperature control, etc.

The operation panel 170 is configured to accept user operations, to inform the controller 110 of the contents. It may be a display of touch-panel type. The image scanner 180 is configured to optically scan an original, for a conversion into a set of image data to be output to the controller 110.

In the controller 110, the power controller 111 is configured to work with a continuous waiting of the inkjet printer 100 exceeding a prescribed interval of time, to shift the inkjet printer 100 to an energy saving mode. The energy saving mode stops operations of the head controller 120, inkjet head 130, engine controller 140, and image scanner 180, as well as in the ink circulation system 150, and sheet transfer system 160, to reduce power consumption. Therefore, the energy saving mode interrupts circulation of ink and temperature control of ink.

The power controller 111 is configured to work upon reception of a print data or user operation in energy saving mode, to deactivate the energy saving mode. Accordingly, the controller 110 and the operation panel 170 are kept alive even in energy saving mode.

The print controller 112 is configured to control printing processes in course of return to a normal mode after deactivation of energy saving mode.

Generally, inks have their adequate temperature ranges specified for favorable use. At ink temperatures under a reference value, ink may have an increased viscosity, for instance, causing a reduced print quality. Therefore, in states of ink having a lower ink temperature than an adequate temperature range, the ink is heated up to an adequate temperature to make a print.

Ink temperature control is inactive during energy saving mode, as described. There may be a return from energy saving mode with reduced ink temperatures under an adequate temperature range, such as those due to an ambient temperature. In such situations, the print controller 112 works to have ink propelling mechanisms make ink vibrating actions within degrees not to cause ink to be propelled out of ink chambers, without circulation of ink. This ink vibration is kept until ink has an adequate ink temperature, to start a printing.

The ink vibration raises ink temperatures in ink chambers 131. As ink circulation is inactive, temperature-raised ink is kept from running along the ink circulation route IC1, and stays within ink chambers 131. This permits temperatures of ink in ink chambers 131 to rise up to the adequate temperature range faster than by combination of ink circulation and warm-up by heater. This allows for a reduced time from deactivation of energy saving mode to a start of printing in low-temperature situations.

In this embodiment, the inkjet printer 100 is assumed as a color printer using a number of different color inks for printing. Accordingly, it has a head controller 120, an inkjet head 130, an ink circulation system 150, and the like provided for each color.

Figure 2:
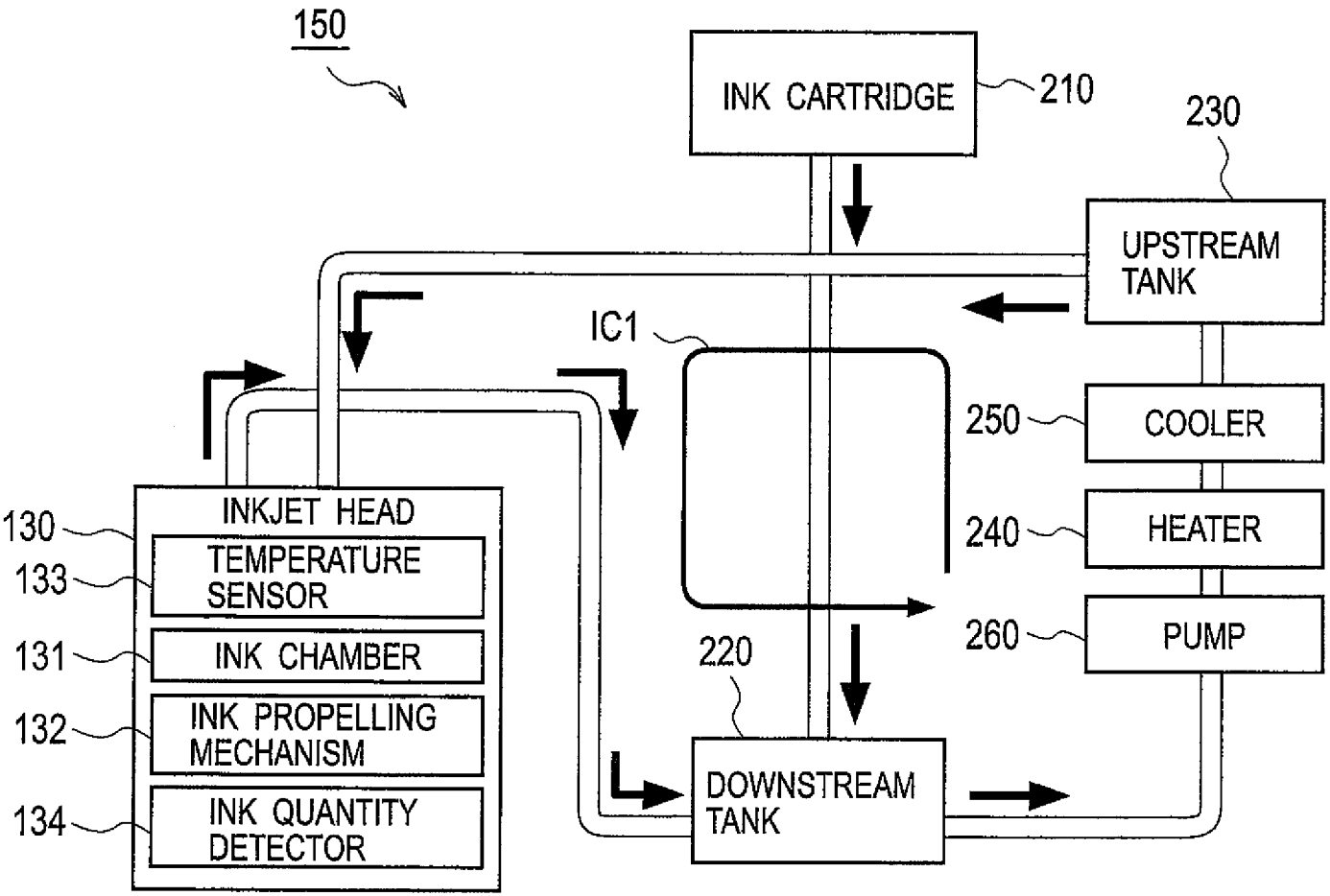
FIG. 2 is a block diagram of configuration of combination of an inlet head and an ink circulation system of the inkjet printer according to the first embodiment.

FIG. 2 shows in block diagram a representative configuration of combination of an inkjet head 130 and an ink circulation system 150 addressed to one of the colors. As shown in the figure, the inkjet head 130 includes ink chambers 131, ink propelling mechanisms 132, a temperature sensor 133, and an ink quantity detector 134. The temperature sensor 133 is adapted to measure a representative ink temperature of the ink chambers 131 directly or indirectly. It may be disposed outside the inkjet head 130 to measure an ink temperature of the ink chambers 131. The ink quantity detector 134 is adapted to detect a representative ink quantity of ink supplied to the ink chambers 131.

The ink circulation route 150 has a looped ink circulation route IC1, and includes a replaceable ink cartridge 210, a downstream tank 220, a pump 260, a heater 240, a cooler 250, and an upstream tank 230.

The ink cartridge 210 supplies ink, which is temporarily stored in the downstream tank 220 installed downstream of the inkjet head 130. Then, ink is delivered by the pump 260 from the downstream tank 220 to the upstream tank 230, where it is supplied for distribution to the ink chambers 131 in the inkjet head 130, where it is used for a printing. Unused ink in the inkjet head 130 is returned again to the downstream tank 220.

The inkjet head 130 is disposed at a higher level than the downstream tank 220, and the upstream tank is disposed at a still higher level than the inkjet head 130. This positional relationship provides head differences assisting the supply of ink from the upstream tank 230 to the inkjet head 130, and the return of ink from the inkjet head 130 to the downstream tank 220.

The heater 240 as well as the cooler 250 is disposed between the downstream tank 220 and the upstream tank 230. The heater 240 is adapted to heat ink when the ink temperature is low. The cooler 250 is configured with a heat sink and an air fan, for instance, and adapted to cool ink when the ink temperature is high.

Figure 3:
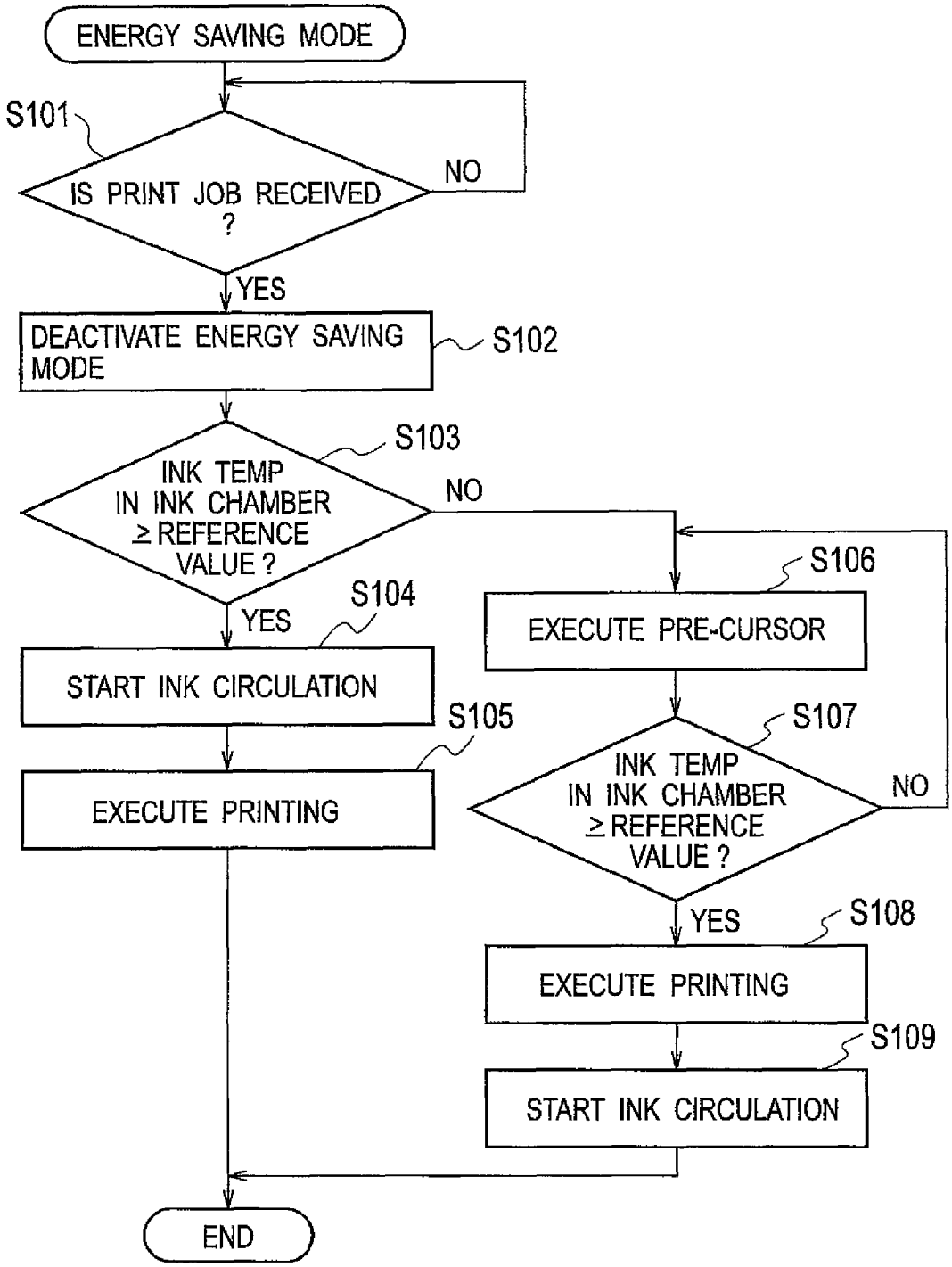
FIG. 3 is a flowchart of control actions for a printing in a return from energy saving mode of the inkjet printer according to the first embodiment.

Description is now made of control actions in a return from energy saving mode of the inkjet printer 100 according to the present embodiment, with reference to a flowchart in FIG. 3.

There will be eliminated redundancy in description associated with an adequate ink temperature range or higher.

With lapse of a prescribed time along a continuous waiting phase, the power controller 111 controls the inkjet printer 111 to shift to an energy saving mode. In the energy saving mode, there is a function kept active simply for reception of a print job or print jobs, and at a step S101, it checks for a reception of print job. Meanwhile, there is no ink circulation, nor ink temperature control being made. The reception of print job may be, among others, a reception of print data from a PC, such as through a LAN, or user operation accepted through the operation panel 170.

Upon reception of a print job (Yes at the step S101), the control flow goes to a step S102, where the power controller 111 deactivates the energy saving mode, powering on the head controller 120, the inkjet head 130, the engine controller 140, the sheet transfer system 160, and the like to restart.

Then, at a step S103, the print controller 112 reads a measure of ink temperature at the temperature sensor 133, and determines whether or not the ink temperature equals to a prescribed reference value or more. This reference value may depend on a lower limit of an adequate temperature range for printing, and may well be 25° C., for instance.

If the ink temperature equals to the reference value or more (Yes at the step S103), then the control flow goes to a step S104 to start circulation of ink, and a step S105 to execute a printing. In this case, the ink temperature resides within an adequate temperature range, and permits a prompt start of printing in the return from energy saving mode.

On the other hand, if the ink temperature is lower than the reference value (No at the step S103), then the control flow goes to a step S106 to have the ink propelling mechanisms 132 make a pre-cursor, without circulation of ink. The pre-cursor is a sequence of wavy motions of a piezoelectric element actuated to cause vibrations of ink in an ink chamber 131, within degrees not to propel ink out.

The foregoing print control includes bifurcated flows of control actions (steps S102 to S104, and steps S102 to S107) between deactivation of energy saving mode and execution of a printing, which are referred herein to as a pretreatment for the printing.

Figure 4:
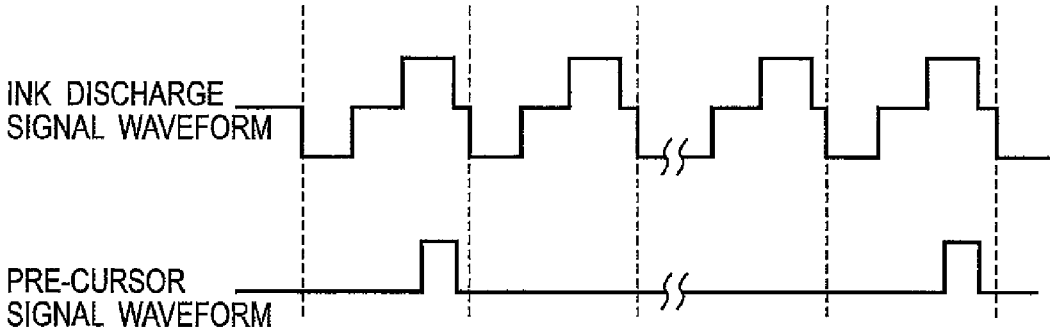
FIG. 4 is a time chart of waveforms of an ink discharge signal and a pre-cursor signal of the inkjet printer according to the first embodiment.

FIG. 4 shows, in a time chart, waveforms of an ink discharge signal to be applied to a piezoelectric element for discharge of ink, and waveforms of a pre-cursor signal to be applied to the piezoelectric element for a pre-cursor. Those signals are output from the head controller 120.

As shown in the figure, the ink discharge signal has a waveform as a pulse set composed of a negative-voltage pulse for swelling an ink chamber, and a positive-voltage pulse for contracting the ink chamber, the waveform being repeated a number of times corresponding to a required number of droplets. Instead, the pre-cursor signal is applied not for actions to propel ink out, but for actuation of a piezoelectric element for the purpose of vibrating ink within a range of degrees not to propel ink out. Accordingly, this signal has a waveform composed of a positive-voltage pulse or a negative-voltage pulse, whichever is applied.

The pre-cursor causes dissipation of heat at a piezoelectric element and a driver involved in an ink propelling mechanism 132, as well as generation of heat due to vibrations of ink in an associated ink chamber 131. Such heat warms ink in the ink chamber 131.

Since ink is not circulated, warmed ink in ink chambers 131 stays in the ink chambers 131. Therefore, temperatures of ink in ink chambers 131 can be raised with an enhanced efficiency.

The pre-cursor is continued (No at the step S107) till the ink temperature of ink in ink chambers 131 reads a measure equal to a reference value or more. If the ink temperature of ink in ink chambers 131 is equal to the reference value or more (Yes at the step S107), then the pre-cursor is stopped, and the control flow goes to a step S108 to execute a printing. Afterward, with the printing ended, it goes to a step S109 to enter a normal waiting state. Here, the heater 240 is operated to heat ink, so circulating ink has an ink temperature within the adequate temperature range.

Figure 5:
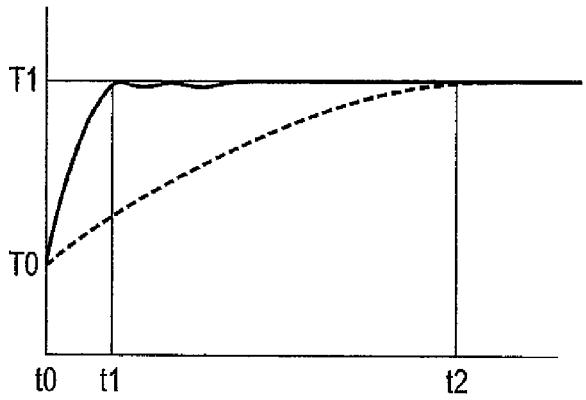
FIG. 5 is a graph representing an effect of the inkjet printer according to the first embodiment.

FIG. 5 shows, in a graph for comparison of warm-up from a low ink temperature, an example of temperature-rise of ink in ink chambers 131 heated with heater 240 and circulated in a conventional manner of temperature control, and an example of temperature-rise of ink in ink chambers 131 heated by pre-cursor, without circulation of ink, in a manner of temperature control compliant with the present embodiment. In the figure, dotted lines represent the former, and solid lines represent the latter.

Starting from deactivation of energy saving mode at a time t0, ink in ink chambers 131 was heated from an ink temperature T0 lower than a temperature T1 being a reference value, whereby the ink temperature was raised up to the reference temperature T1 at a time t2 corresponding to a start time of printing in the conventional manner. To this point, in the embodiment-compliant manner, the ink temperature was raised up to the reference temperature T1 at a time t1 earlier than the time t2, permitting a printing to be started at the time t1.

Such being the case, according to the present embodiment, there is an inkjet printer of ink circulation type including an ink circulation route adapted to work in a low-temperature state of ink, allowing for a reduced interval of time from deactivation of energy saving mode to a start of printing.

Description is now made of an inkjet printer 100 adapted for another example of print control according to the present embodiment. In the foregoing example of embodiment, as ink is in a low-temperature state, temperatures of ink in ink chambers 131 are raised by a pre-cursor without circulation of ink, to execute a printing.

However, ink chambers 131 have a finite quantity of ink stored therein that may be depleted as warmed ink is consumed for printing, or may have flux of low-temperature ink inflowing to ink chambers 131.

Figure 6:
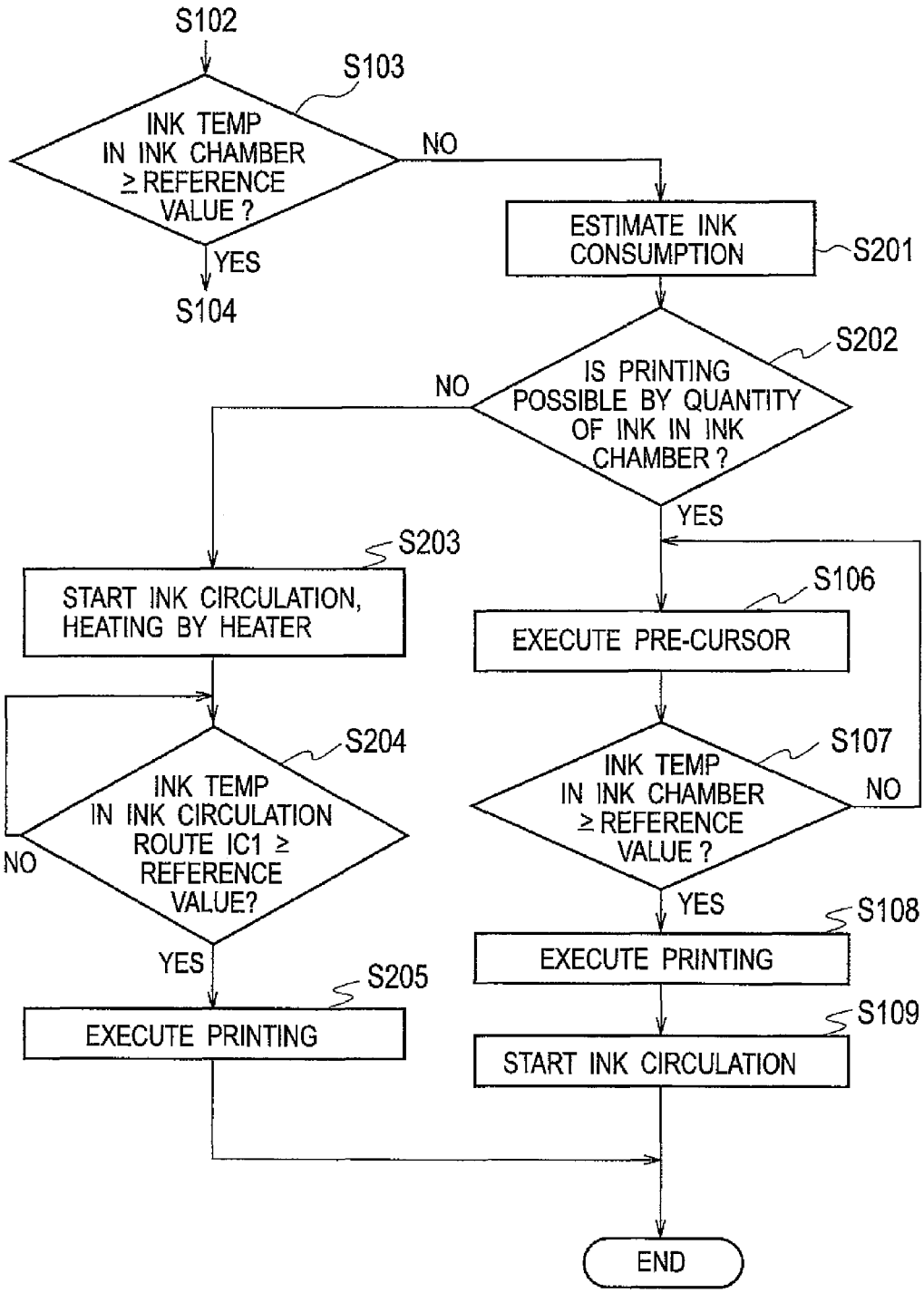
FIG. 6 is a flowchart of control actions for a printing in a different control mode of the inkjet printer according to the first embodiment.

In this regard, there may be estimation of an ink quantity to be consumed for printing a received print job as shown by a flowchart in FIG. 6, to implement the foregoing process steps when and only if the printing is determined to be possible simply with a quantity of ink stored and warmed in ink chambers 131.

The flowchart in FIG. 6 is connected the flowchart in FIG. 3, so like steps are designated by like reference characters, with omission of redundancy.

At the step S103 determining whether or not the ink temperature at deactivation of energy saving mode equals to a reference value or more, if the ink temperature is lower than the reference value (No at the step S103), then the control flow goes to a step S201 to estimate an ink quantity to be consumed for printing a received print job.

The quantity of ink to be consumed may be estimated as a quantity of ink of an ink droplet to be propelled by one shot times a total number of ink droplets calculated from a set of ink discharge data, for instance. Or, it may be a quantity of ink to be consumed per one sheet as it is estimated from an average print ratio. The quantity of ink to be consumed is estimated every ink color, to determine the color of ink to be most consumed, to employ consumption thereof as a basis.

Then, at a step S202, comparing a quantity of ink stored in ink chambers 131 as detected by the ink quantity detector 134, with a quantity of ink estimated to consume, it is determined whether or not the above-noted printing is possible by the detected quantity of ink in ink chambers 131. There may be an amount of ink consumption assumed for an average content of print, to be based on to estimate a printable number of sheets in advance, for use for a facilitated decision to an even or smaller number of sheets to be printed, to determine that the printing should be possible by a quantity of ink in ink chambers 131.

If the printing is possible by the detected quantity of ink in ink chambers 131 (Yes at the step S202), then the control flow goes to a step S106 to have ink propelling mechanisms 132 make a pre-cursor without circulation of ink, as described. And, if the ink temperature of ink in ink chambers 131 is equal to a reference value or more (Yes at a step S107), then the pre-cursor is stopped, and the control flow goes to a step S108 to execute the printing. Afterward, with the printing ended, it goes to a step S109 to enter a normal waiting state.

On the other hand, unless the printing is possible by the detected quantity of ink in ink chambers 131 (No at the step S202), the control flow goes to a step S203 to start circulating ink, and heating ink by the heater 240, without use of pre-cursor for ink heating. And, if the ink temperature is raised up to a reference value or more (Yes at a step S204), then the control flow goes to a step S205 to execute the printing. This prevents the printing from suffering depletion of ink on the way, or from being made with low-temperature ink.

This print control includes bifurcated flows of control actions (steps S102 to S204, and steps S102 to S107) between deactivation of energy saving mode and execution of a printing, which are referred herein to as a pretreatment for the printing.

Second Embodiment

Figure 7:
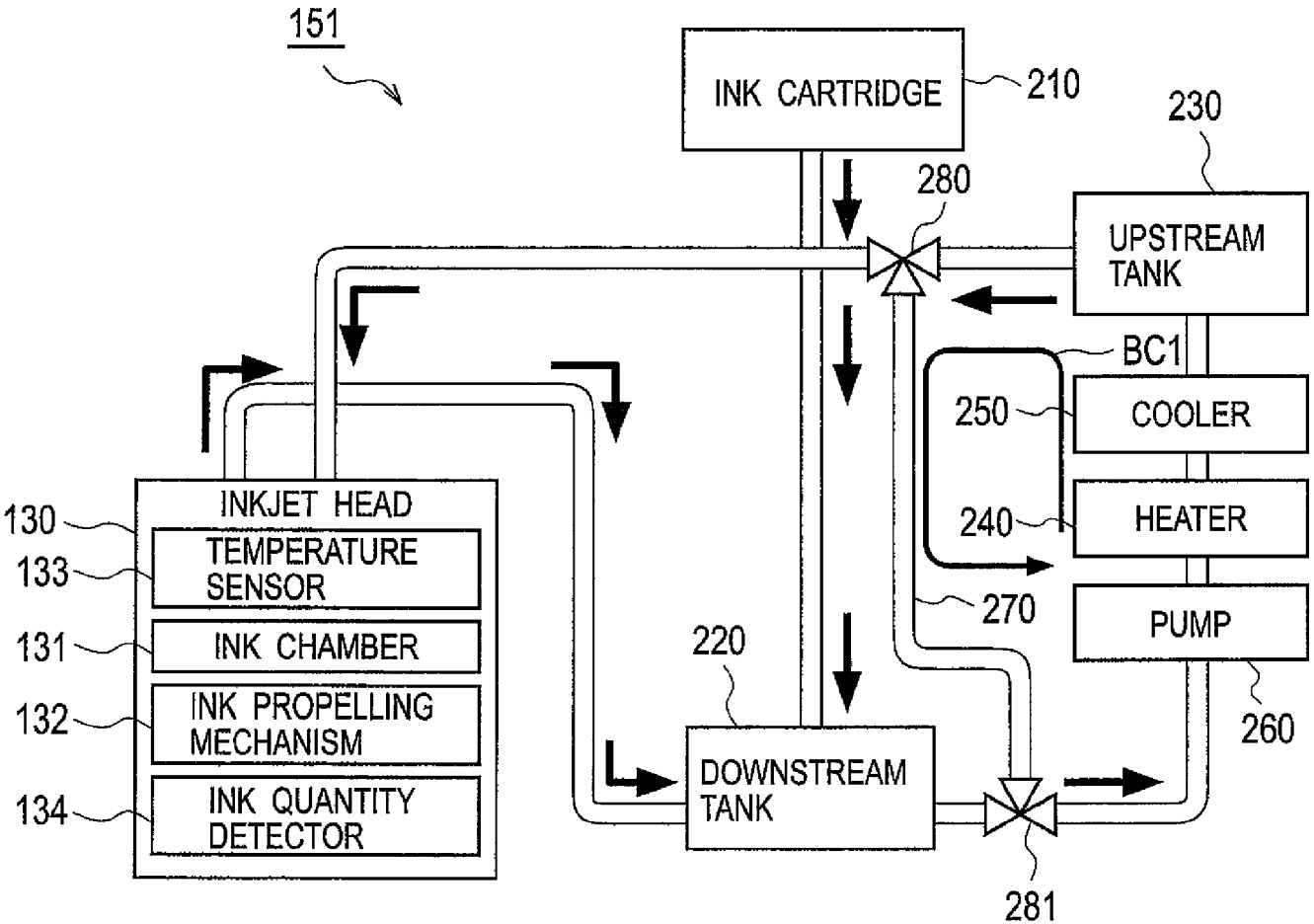
FIG. 7 is a block diagram of configuration of combination of an inkjet head and a bypass circulation route of an inkjet printer according to a second embodiment of the present invention.

Description is now made of a second embodiment, with reference to associated drawings. FIG. 7 shows in block diagram a configuration of combination of an inkjet head and an ink circulation system of an inkjet printer 100*a* (see FIG. 1) according to the second embodiment. According to this embodiment, the inkjet printer 100*a* is configured as a modification of the inkjet printer 100 according to the first embodiment that includes an ink circulation system provided with a bypass circulation route 270 as shown in FIG. 7, which system is referred herein to as an ink circulation system 151. This modification calls for a different method of print control at a controller 110, while other constituent elements and actions are substantially similar to the first embodiment, and redundant description is omitted.

As shown in FIG. 7, the bypass circulation route 270 is provided as a bypass to an inkjet head 130 on the ink circulation route IC1 in the first embodiment, in the form of a direct route for interconnection between a route section that interconnects the inkjet head 130 with an upstream tank 230, and a route section that interconnects a downstream tank 220 with a heater 240. There is an ink circulation route IC1 for circulating ink through the upstream tank 230, the inkjet head 130, the downstream tank 220, a pump 260, the heater 240, and a cooler 250 to come round to the upstream tank 230. To this ink circulation route IC1, the provision of bypass route 270 constitutes a bypass circulation route BC1 for circulating ink through the upstream tank 230, the pump 260, the heater 240, and the cooler 250 to come round to the upstream tank 230, bypassing the inkjet head 130.

Three have been: a print control described with reference to FIG. 3 according to an example of the first embodiment having a measure of ink temperature of ink in ink chambers 131, as a condition thereto; and a print control described with reference to FIG. 6 according to a modified example having a quantity of ink estimated to consume for printing a received print job, as an additional condition to execute the printing without circulation of ink, if and only when the print job can be printed simply by a quantity of ink in ink chambers 131. The examples of print control shown in FIG. 3 and FIG. 6 have been common in stopping circulation of ink for the inkjet head 130 to make a pre-cursor to raise temperatures of ink in ink chambers 131. This has been to prevent flux of temperature-raised ink from being forced out of ink chambers 131 by circulation of ink. Instead, there has been a whole amount of ink in the ink circulation route IC1 disabled from being entirely warmed during a period of pre-cursor at the inkjet head 130. There may be an encountered inability of printing by a quantity of ink in ink chambers 131, with the need of re-warming up an entire quantity of ink in the ink circulation route IC1.

Figure 8:
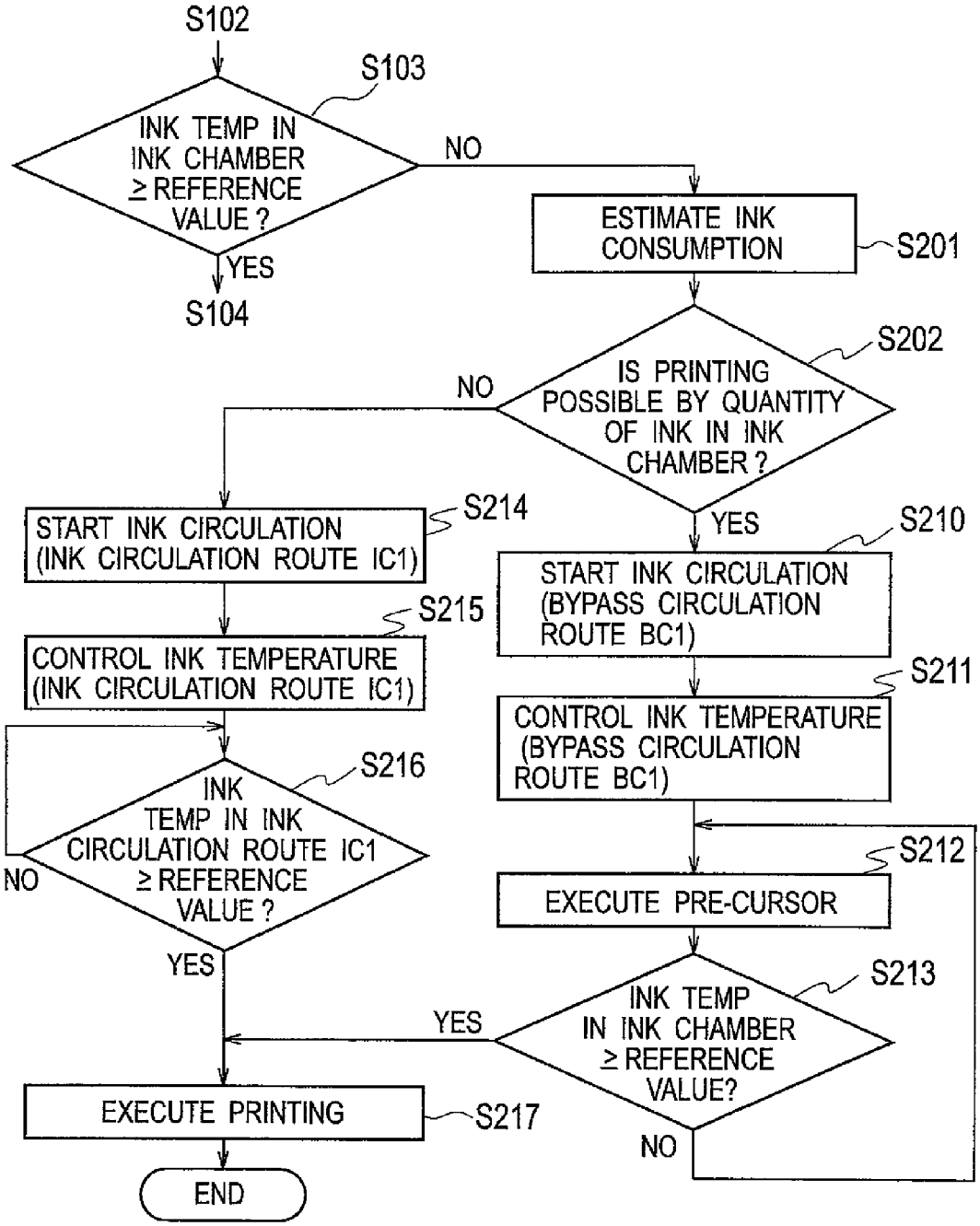
FIG. 8 is a flowchart of control actions for a printing in a return from energy saving mode of the inkjet printer according to the second embodiment.

In this regard, according to the second embodiment, as shown by a flowchart in FIG. 8, the bypass circulation route BC1 affords to make circulation of ink even in a phase of pre-cursor at the inkjet head 130, permitting flux of ink in the upstream tank 230 to be efficiently warmed up in parallel with a current printing, thus allowing for the more reduced time for transition to adequate temperature states of ink from a low ink-temperature state such as in a return from energy saving mode.

The flowchart in FIG. 8 covers steps up to a step S201, which are similar to those up to the step S201 shown by the flowchart in FIG. 6 according to the first embodiment, and there will be description of subsequent steps, omitting redundancy.

At a decision step S202 determining whether or not a current printing is possible by a detected quantity of ink in ink chambers 131, if it is possible (Yes at the step S202), then the control flow goes to a step S210 for the controller 110 to operate the pump 260 installed in the bypass circulation route BC1, and turn on three-way valves 280 and 281 (see FIG. 7), to start circulation of ink in the bypass circulation route BC1. Then, at a step S211, the heater 240 is operated to heat ink in the bypass circulation route BC1. And, at a step S212, ink chambers 131 enter a pre-cursor to raise temperatures of ink therein. The pre-cursor is continued while ink in ink chambers 131 has a measure of ink temperature under a reference value (No at a step S213). If the ink temperature of ink in ink chambers 131 becomes a reference value or more (Yes at the step S213), then the control flow goes to a step S217 to execute the printing.

On the other hand, at the step S202, unless the printing is possible by a quantity of ink in ink chambers 131 (No at the step S202), the control flow goes to a step S214 to start circulation of ink in the ink circulation route IC1 without pre-cursor at ink chambers 131, and a step S215 to heat an entire quantity of ink in the ink circulation route IC1 by the heater 240. And, if the ink temperature is raised to a reference value or more (Yes at a step S216), the control flow goes to the step S217 to execute the printing. The above-noted object is thus achieved.

This print control includes flows of control actions (steps S102 to S216) between deactivation of energy saving mode and execution of a printing, which are referred herein to as a pretreatment for the printing.

According to the second embodiment, the inkjet printer 100*a* has a bypass circulation route provided to bypass the inkjet head 130 on the ink circulation route IC1 in the first embodiment, as a direct mute for interconnection between a mute section that interconnects the inkjet head 130 with the upstream tank 230, and a route section that interconnects the downstream tank 220 with the heater 240. However, instead, there may be a bypass route otherwise provided to achieve like objective. For instance, there may be a bypass route provided to bypass the inkjet head 130 on the ink circulation route IC1 in the first embodiment, as a direct route for interconnection between a route section that interconnects the inkjet head 130 with the upstream tank 230, and a route section that interconnects the inkjet head 130 with the downstream tank 220. In this case, the provision of bypass route constitutes a bypass circulation route for circulating ink through the upstream tank 230, the downstream tank 220, the pump 260, the heater 240, and the cooler 250 to come round to the upstream tank 230, bypassing the inkjet head 130. This bypass circulation route is adapted for circulation era to thereby efficiently warm flux of ink in the downstream tank 220 and the upstream tank 230 in parallel with a printing, thus allowing for a still reduced time for transition to adequate temperature states of ink from a low ink-temperature state such as in a return from energy saving mode. It however is noted that this configuration needs a negative pressure generator additionally installed on a route section interconnecting the inkjet head 130 with one of paired three-way valves or a route section interconnecting the inkjet head 130 with the other three-way valve, for exertion of an adequate negative pressure to the inkjet head 130.

Further, there may be a bypass route provided to bypass the inkjet head 130 on the ink circulation route IC1 in the first embodiment, as a direct route for interconnection between a route section that interconnects the inkjet head 130 with the downstream tank 220, and a route section that interconnects the upstream tank 230 with the cooler 250. In this case, the provision of bypass route constitutes a bypass circulation route for circulating ink through the downstream tank 220, the pump 260, the heater 240, and the cooler 250 to come round to the downstream tank 220, bypassing the inkjet head 130. This bypass circulation route is adapted for circulation of ink to thereby efficiently warm flux of ink in the downstream tank 220 in parallel with a printing, thus allowing for a still reduced time for transition to adequate temperature states of ink from a low ink-temperature state such as in a return from energy saving mode. It however is noted that this configuration needs a negative pressure generator additionally installed on a route section interconnecting the inkjet head 130 with the upstream tank 230, for exertion of an adequate negative pressure to the inkjet head 130.

Figure 9:
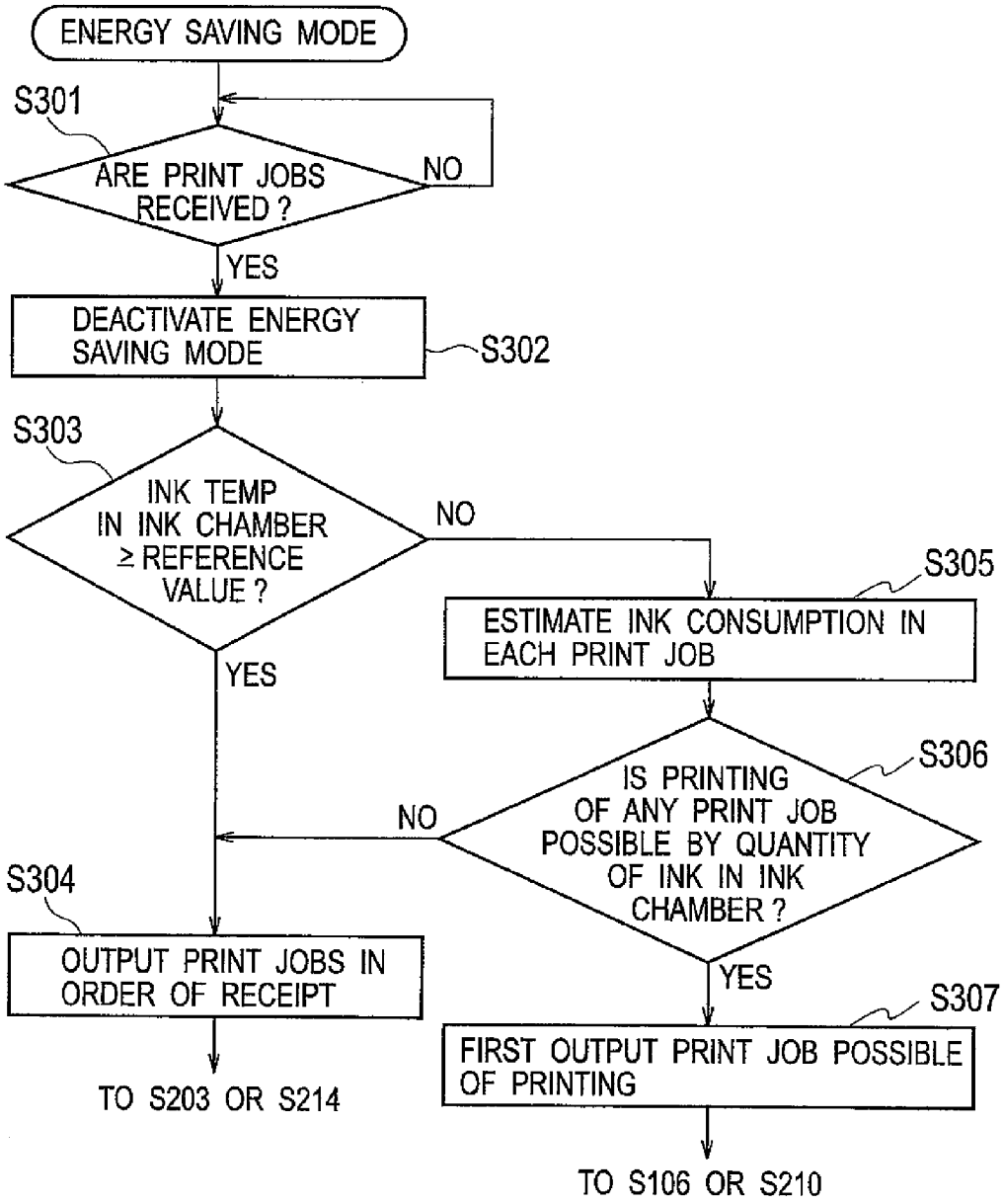
FIG. 9 is a flowchart of control actions for a printing to implement print jobs received in a return from energy saving mode, in a form common to the inkjet printer according to the first embodiment and the inkjet printer according to the second embodiment.

Description is now made of a modified example of print control having a plurality of print jobs received in a return from energy saving mode in either of the inkjet printers 100 and 100*a* according to the first and the second embodiment, respectively. FIG. 9 shows, in a flowchart, control actions for a printing to implement print jobs received in a return from energy saving mode in either of the inkjet printers 100 and 100*a*. At a decision step S301 determining whether or not the inkjet printer 100 or 100*a* has received print jobs, if it has received print jobs (Yes at the step S301), then the control flow goes to a step S302 for the power controller 111 to deactivate the energy saving mode, powering on the head controller 120, the inkjet head 130, the engine controller 140, the sheet transfer system 160, and the like to restart.

Then, at a step S303, the print controller 112 reads a measure of ink temperature at the temperature sensor 133, and determines whether or not the ink temperature of ink in ink chambers 131 equals to a prescribed reference value or more. This reference value may depend on a lower limit of an adequate temperature range for printing, and may well be 25° C., for instance.

As a result, if the ink temperature of ink in ink chambers 131 equals to the reference value or more (Yes at the step S303), then the control flow goes to a step S304 to output sets of print data in the order of received print jobs, to proceed to the step S104 or S214 in the first or second embodiment, respectively.

On the other hand, if the ink temperature of ink in ink chambers 131 is lower than the reference value (No at the step S303), then the control flow goes to a step S305 for the ink quantity analyzer 114 to estimate a quantity of ink to be consumed for a printing of print data of each print job input thereto.

Then, at a step S306, collation is made of quantities of ink estimated to consume for printing the print jobs, with a quantity of ink stored in ink chambers 131 as detected by the ink quantity detector 134 in the inkjet head 130, to check for a print job printable by a quantity of ink in ink chambers 131, to determine if any.

As a result of determination, if there is any print job printable by a quantity of ink in ink chambers 131 (Yes at the step S306), then the control flow goes to a step S307 to output one or more sets of print data in sequence, with priority to a current printable print job, to proceed to the step S106 or S210 in the first or second embodiment, respectively.

On the other hand, if there is no print job printable by a quantity of ink in ink chambers 131 (No at the step S306), the control flow goes to the step S304 to output sets of print data in the order of received print jobs, to proceed to the step S104 or S214 in the first or second embodiment, respectively.

Such a pretreatment affords a printing with an enhanced efficiency even in reception of print jobs in a low-temperature phase of ink temperature in a return from energy saving mode.

The above print control includes flows of control actions (steps S102 to S204, steps S102 to S107, and steps S102 to S216) between deactivation of energy saving mode and execution of a printing, which are referred herein to as a pretreatment for the printing.

Third Embodiment

Figure 10:
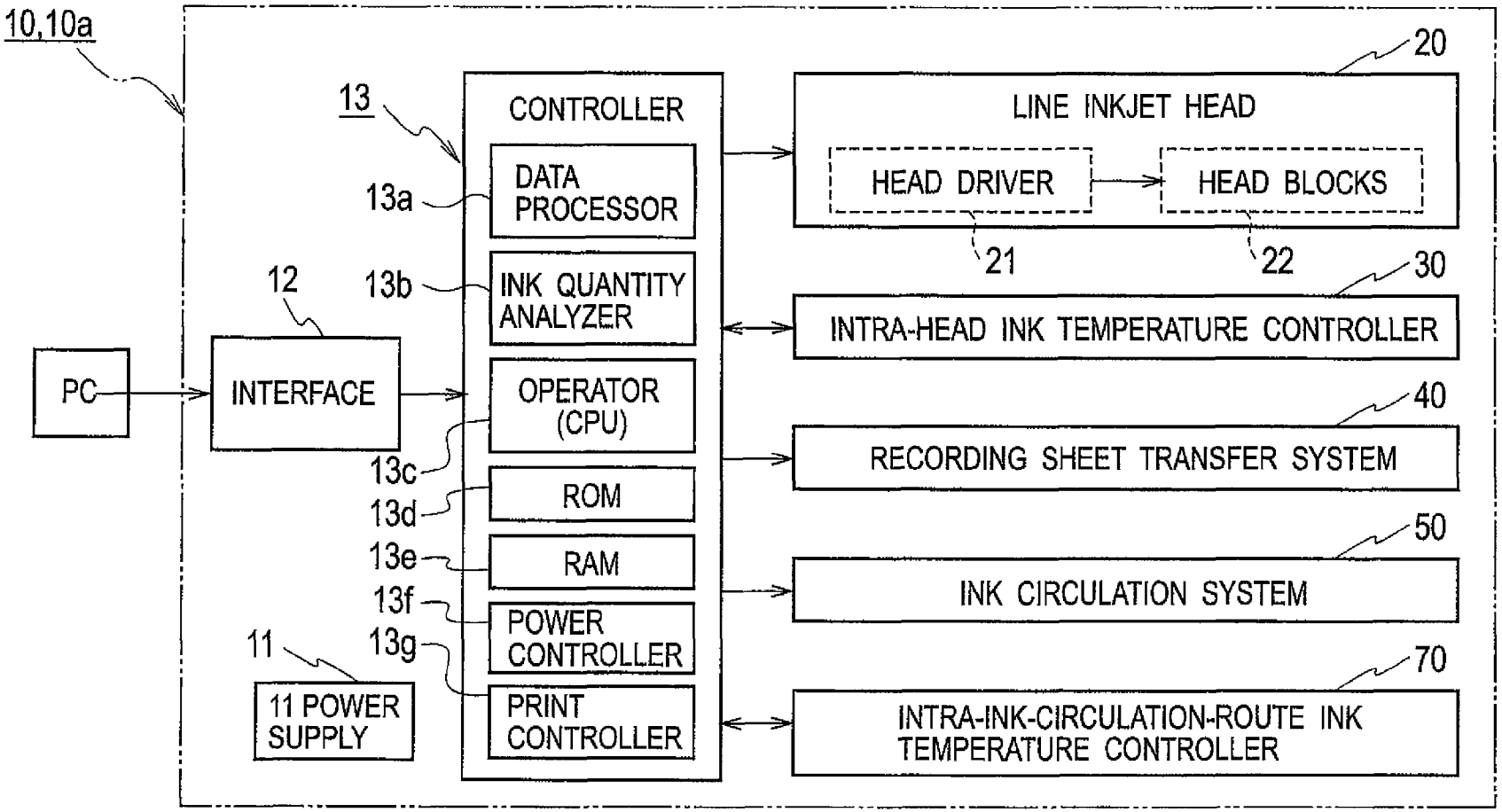
FIG. 10 is a block diagram of entire configuration of an inkjet printer according to a third embodiment of the present invention.

Description is now made of a third embodiment of the present invention, with reference to associated drawings. FIG. 10 shows in block diagram an entire configuration of an inkjet printer 10 according to this embodiment. As shown in the figure, the inkjet printer 10 includes a power supply 11, an interface 12, a controller 13, a combination of line inkjet heads 20 corresponding to ink colors, an intra-head ink temperature controller 30, a recording sheet transfer system 40, an ink circulation system 50, and an intra-ink circulation route ink temperature controller 70. The interface 12 is connected to a personal computer PC, non-depicted LAN cable, etc, in a disconnectable manner. The controller 13 is configured to govern an entire control of the machine. The one or more line inkjet heads 20 are each configured with a head driver 21 and a print-line-covering number of head blocks 22 operable to propel ink droplets onto a recording sheet in accordance with a print data The intra-head ink temperature controller 30 is configured to control an ink temperature of ink in a line inkjet head 20. The recording sheet transfer system 40 is configured for transfer of recording sheets. The ink circulation system 50 is configured for circulation of ink between the line inkjet head 20 and an ink-storing ink tank 53 (see FIG. 11), and is adapted to stop ink circulation, as well. The intra-ink circulation route ink temperature controller 70 is configured to control an ink temperature of ink in an ink circulation route IC2 (see FIG. 11).

The inkjet printer 10 has incorporated components, of which principal ones will be described in sequence.

The controller 13 includes, among others, a controller substrate provided with a CPU, memories, etc. for image processing, print job control, and the like. In other words, it implements a sequence of processes including a process of generating ink discharge data based on an image frame to be printed. The image frame to be printed may be given as a set of print data such as those input from the personal computer PC through a LAN cable (not shown).

More specifically, the controller 13 includes: a data storing processor 13*a* configured for temporary storage of and to process a set of print data input thereto; and an ink quantity analyzer 13*b* configured to have, before a printing of such print data, information on a print job or print jobs pertaining to the print data, for analysis thereof to determine a quantity V (see FIG. 14) of ink necessitated for the printing of print data. Moreover, it includes: an operator 13*c*; a ROM 116 adapted for storage of programs such as a control program of the inkjet printer 10; and a RAM 13*e* adapted for temporary storage of data on variables associated with actions of the inkjet printer 10. It further includes: a power controller 13*f* configured to control a shift to an energy saving mode of the inlet printer 10 and a return from the energy saving mode; and a print controller 13*g* configured to control a process of printing such as along the return from energy saving mode or upon power-on of the printer 10.

This embodiment has the data storing processor 13*a* and the ink quantity analyzer 13*b* both incorporated in the controller 13. However, there may be a data storing processor and/or an ink quantity analyzer adapted to be similar thereto in function, and separated from a controller, with interfaces in between for component-wise signal transmission and reception.

There are line inkjet heads 20 one-to-one corresponding to primary color inks in use. In this embodiment, the inkjet printer 10 (FIG. 10) is adapted to print (record) input print data on a sheet in colors produced by combination of primary color inks being C (cyan), K (pure black), M (mazenta), and Y (yellow), for instance. Accordingly, there are line inkjet heads 20 (four in number: more specifically, 20 for C, 20 for K, 20 for M, and 20 for Y) arrayed in correspondence to ink colors C, K, M, and Y, in a specified recording order of C, K, M, and Y, in a transfer direction of recording sheet PA (that is a direction indicated by an arrow X1 in FIG. 12).

The line inkjet heads (20 for C, 20 for K, 20 for M, and 20 for Y) have a similar configuration, and will be collectively described with respect to a representative one 20.

This line inkjet head 20 is configured with a built-in head driver 21, and a combination of two-dimensionally spaced arrays of head blocks 22 having their sets of nozzles 22*n* each respectively aligned in a principal scan direction. For instance, in FIG. 12 that is a plan view of more specific example of configuration of the embodiment, there are nozzles 22*n* aligned in a transverse direction along a Y-axis, which is a principal scan direction in this case. In the example of FIG. 12, like the example shown in FIG. 11, there are six head blocks 22 (with head numbers Hn=1 to Hn=6) grouped into a set of three head blocks 22 (Hn=1, 3, 5) aligned to a reference line 1, and a set of three head blocks 22 (Hn=2, 4, 6) aligned to a reference line 2. The reference lines 1 and 2 are each oriented in the principal scan direction, and spaced from each other in a bi-scan direction, that is, in a longitudinal direction along an X-axis in FIG. 12. The head blocks 22 on the neighboring lines 1 and 2 are arranged to stagger in between, to overlap in part.

In such the line inkjet head 20, the intra-head ink temperature controller 30 is adapted to control temperatures of ink supplied inside thereof to a target ink temperature TM (see FIGS. 15, 16, 17, and 18) set up as an optimal within an applicable ink temperature range defined by and between a lower limit of ink temperature TL (see FIGS. 15, 16, and 18) and an upper limit of ink temperature TH (see FIG. 18) compliant with a given ink specification.

The intra-head ink temperature controller 30 includes an intra-head ink temperature detector (referred herein to as a first thermometer) 31, a first heater 32, and an intra head ink quantity acquirer (referred herein to as a first ink quantity detector) 33. The first thermometer 31 may be configured with a thermistor or the like to detect an ink temperature of ink in the line inkjet head 20. The first heater 32 is adapted to work to heat ink in the line inkjet head 20 when the ink temperature is lower than the target ink temperature TM (cf. e.g. FIG. 15). The first ink quantity detector 33 is adapted to measure a quantity Vp (see FIG. 14) of ink supplied inside a common ink supply chamber 23 (see FIG. 11) in the line inkjet head 20. For the intra-head ink temperature controller 30, detail actions will be discussed later on.

Figure 11:
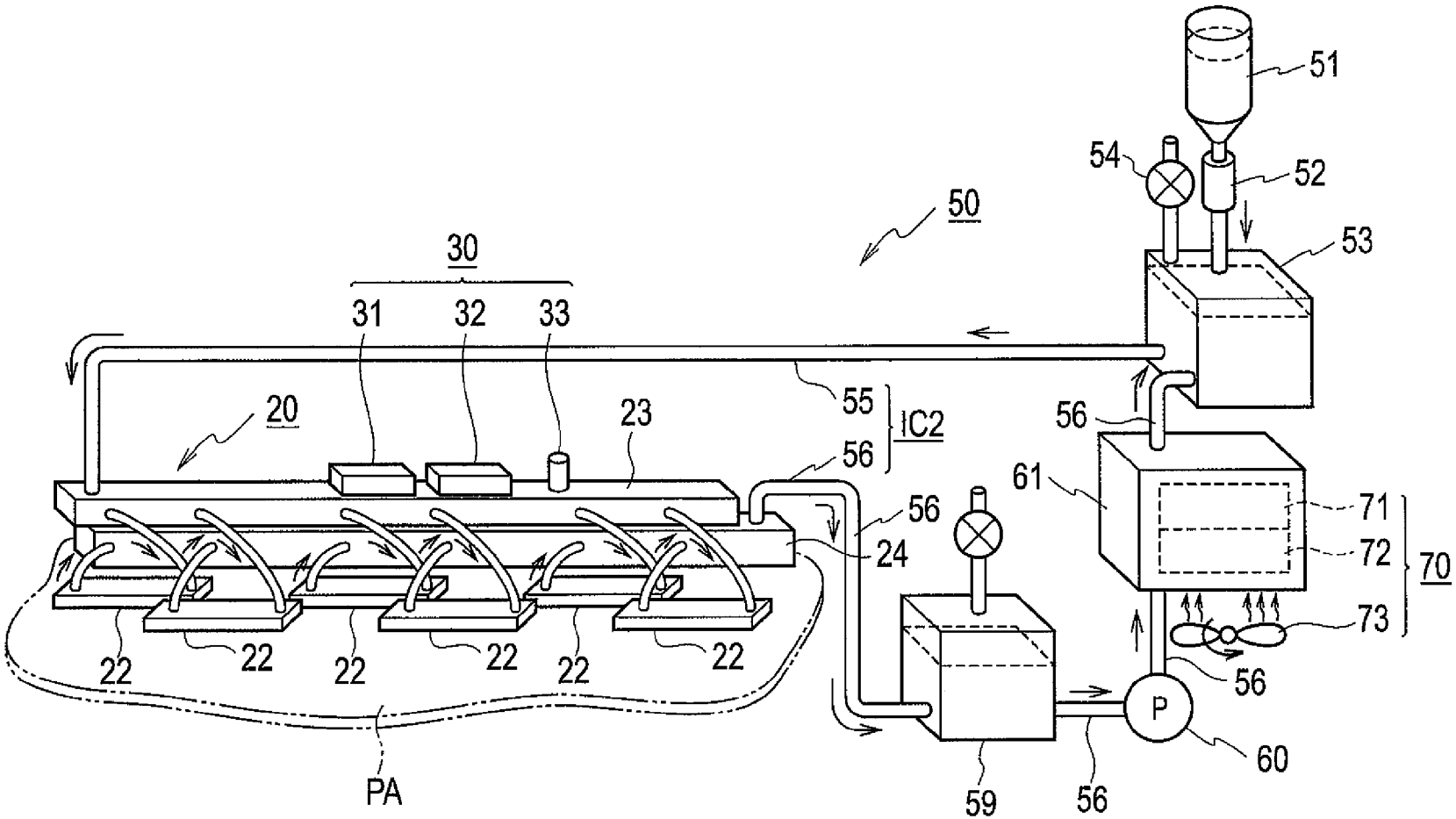
FIG. 11 is a schematic perspective view of combination of a line inkjet head and an ink circulation system of the inkjet printer according to the third embodiment.
Figure 12:
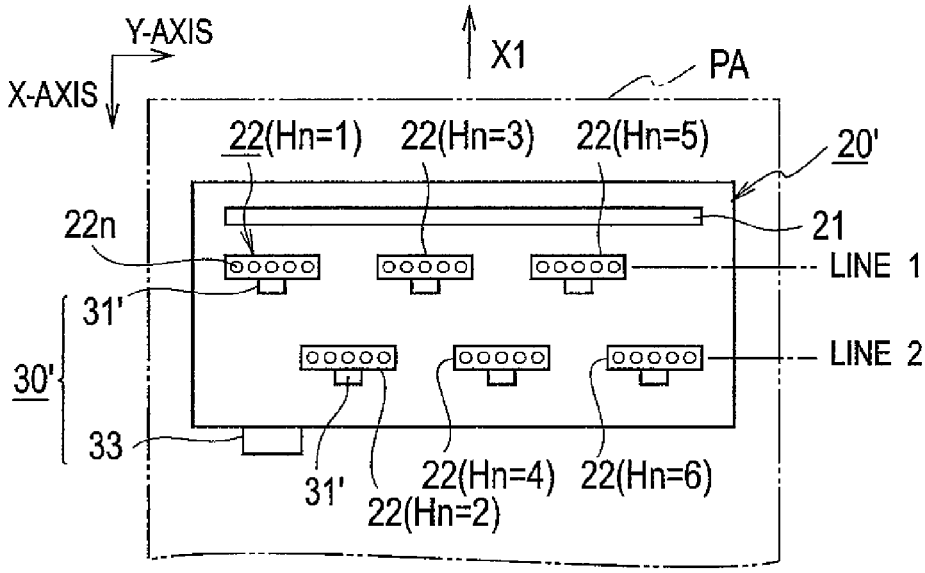
FIG. 12 is an enlarged plan view of a line inkjet head as a partial modification of the line inkjet head of the inkjet printer according to the third embodiment.

In this embodiment, the line inkjet head 20 employs the ink quantity detector 33 to measure an ink quantity Vp in a common ink supply chamber 23 (see FIG. 11). Instead, the common ink supply chamber 23 may have an inner volume thereof stored in the RAM 13*e* in the controller 13, as an ink quantity Vp in the common ink supply chamber 23 to be read in a state of the common ink supply chamber 23 filled with ink, for use before a start of printing. The data on Vp stored in the RAM 13*e* can eliminate the need of provision of an ink quantity detector 33. In this case, the RAM 13*e* in the controller 13 constitutes an intra-head ink quantity acquirer.

Each head block 22 is configured to propel ink droplets through selective nozzles 22*n*. This inkjet system may be, among others: a piezoelectric system that applies drive signals to piezoelectric elements behind nozzles 22*n*, for displacement of vibration plates to propel ink out of ink pool chambers, as droplets through nozzles; an electrostatic system that applies drive signals to electrostatic gaps, for displacement of vibration plates to propel ink out of ink pool chambers, as droplets through nozzles; or a film boiling inkjet system that heat ink with miniature heaters in ink pool chambers, to bring into a film boiling state generating bubbles with pressure variations, thereby propelling ink as droplets throw h nozzles, whichever is applicable in accordance with the invention. The present embodiment employs a piezoelectric system affording a simplified structure with a favorable integrity.

As illustrated in FIG. 11, the ink circulation system 50 has an inkbottle 51 inserted to a detachable connection tube 52, to supply ink from the inkbottle 51 through the connection tube 52 to a first ink tank (referred herein to as an upper ink tank) 53. In this embodiment, ink is supplied from the replaceable inkbottle 51 into the upper ink tank 53. Instead, the upper ink tank 53 may be provided with an ink supply port (not shown) to supply ink through the ink supply port, without application of an inkbottle 51.

The upper ink tank 53 is connected to the common ink supply chamber 23 provided as an upstream ink chamber for distribution of ink to the head blocks 22 in the line inkjet head 20, by an ink supply route 55 as a piping for interconnection in between. The upper ink tank 53 has thereon a first electromagnetic valve 54 operable for control to make an air chamber in the upper ink tank 53 air-sealed or open to the air.

In the line inkjet head 20, the common ink supply chamber 23 is provided with the intra-head ink temperature controller 30 including the first thermometer 31, the first heater 32, and the first ink quantity detector 33, as described.

The line inkjet head 20 has a common ink collection chamber 24 installed downstream of the head blocks 22, which is connected to the upper ink tank 53 via an ink collection route 56 provided as a piping in between with a second electromagnetic valve 58 installed thereon for on-off control. The ink collection route 56 includes: a second ink tank (referred herein to as a lower ink tank) 59 for storage of ink collected from the common ink collection chamber 24; a pump 60; and a heat exchanger 61. The lower ink tank 59 has thereon a second electromagnetic valve 58 operable for control to make an air chamber in the lower ink tank 59 air-sealed or open to the air.

The ink circulation system 50 thus has an ink circulation route IC2 composed of the ink supply route 55 and the ink collection route 56, for circulation of ink therein with local controls operable under control of the controller 13. In the ink circulation system 50, the first and second electromagnetic valves 54 and 58 are operable to turn onto: supply ink stored in the upper ink tank 53, through the ink supply route 55, to the common ink supply chamber 23 of the line inkjet head 20; distribute ink from the common ink supply chamber 23 to the head blocks 22 in a two-dimensional array, permitting ink droplets to be selectively propelled from nodes of the head blocks 22 onto a recording sheet PA; collect unused or excessive ink from the head blocks 22 into the common ink collection chamber 24; and conduct ink from the common ink collection chamber 24, through part of the ink collection route 56, to the lower ink tank 59 for temporary storage.

Afterward, stored ink in the lower ink tank 59 is pumped by the pump 60 to return to the upper ink tank 53, through the heat exchanger 61 working for thermal control to set the ink temperature of ink in the ink circulation route IC2 to a prescribed temperature.

In this respect, the heat exchanger 61 is provided with the intra-ink circulation route ink temperature controller 70 configured to control the ink temperature of ink in the ink circulation route IC2 to set in a vicinity of a target ink temperature M within the ink applicable range.

The intra-ink circulation route ink temperature controller 70 includes a circulating ink temperature detector (referred herein to as a second thermometer) 71, a second heater 72, and a cooler (referred herein to as a cooling fan) 73. The second thermometer 71 may be configured with a thermistor or the like to detect an ink temperature of ink in the ink circulation route IC2. The second heater 72 is configured to heat ink in the ink circulation route IC2. The cooling fan 73 is configured to cool ink in the ink circulation route IC2. For the intra-ink circulation route ink temperature controller 70, detail actions will be discussed later on.

According to the present embodiment, the inkjet printer 10 has the line inkjet head 20 with a configuration illustrated in FIG. 11, which may well be modified in part to provide a line inkjet head 20' with a configuration illustrated in FIG. 12.

For instance, like the line inkjet head 20, the line inkjet head 20' has two sets of three head blocks 22 numbered Hn=1, 3, 5 and Hn=2, 4, 6, and aligned to reference lines 1 and 2, respectively. However, unlike the line inkjet head 20, the line inkjet head 20' has a common ink supply chamber 23 (see FIG. 11) provided with an intra-head ink temperature controller 30' excluding the first thermometer (31 in FIG. 11) and the first heater (32 in FIG. 11).

The intra-head ink temperature controller 30' has an ink quantity detector 33 provided to the common ink supply chamber 23 (FIG. 11) of the line inkjet head 20', and a set of intra-head ink temperature detectors (referred herein to as first thermometers) 31' each configured with a thermistor or the like and provided to a corresponding one of head blocks 22. In place of a first heater, there is a set of piezoelectric elements in each head block 22 to make a pre-cursor (minute vibrations) to heat ink in ink pool chambers, within degrees not to propel ink out.

The intra-head ink temperature controller 30' is thus adapted to work before a start of printing to a recording sheet PA, to develop pre-cursor motions of ink in head blocks 22 in the line inkjet head 20' to heat ink therein to a target ink temperature TM, while measuring ink temperatures by the first thermometers 31' at the head blocks 22.

In place of the first thermometers 31' provided at the head blocks 22, there may be a first thermometer 31 (see FIG. 11) provided simply at the common ink supply chamber 23 (FIG. 11), for use in a heating by pre-cursor motions of ink in the head blocks 22, to attain the target ink temperature TM. In this case, there may be use of data on temperatures measured at the first thermometer 31 (FIG. 11), to predict a pre-cursor time as necessary to proceed with pre-cursor to attain the target ink temperature TM.

There may well be use of pre-cursor to heat ink in the line inkjet head 20' (or 20) before start of a printing on a recording sheet PA, as described, eliminating the need f a heater in line inkjet head 20' (or 20), thus allowing for size reduction of line inkjet head 20' (or 20) with a reduced cost.

Description is now made of a concept of technique for controlling the ink temperature of ink in use in the inkjet printer 10 configured as described.

According to the present embodiment, before a printing of print data on a recording sheet PA, there is use of the ink quantity analyzer 13*b* provided in the controller 13 to analyze information of print job pertaining to the print data, to predict an ink quantity V (see FIG. 14) necessitated for printing the print data, for control of the ink temperature of ink in use at the inlet printer 10.

In this regard, the ink quantity analyzer 13*b* provided in the controller 13 is adapted for a process of analyzing or extracting data on a total dot number per one recording sheet, data on print ratios, data on a recording sheet number, and data on a print set number, commensurately each with a recording sheet size, as information of print job pertaining to the print data, to substitute those data and a preset ink quantity per one dot in a prescribed expression for calculation, to thereby determine a quantity V of ink necessitated for the printing of print data.

More specifically, the ink quantity analyzer 13*b* calculates a print ratio of each ink color (C, K, M, Y) in a frame of image data to be printed. For this calculation, for instance, there is a count made of a dot number (pixel number) per unit area of each ink color (C, K, M, Y) in the frame of image data. As image data with low print ratios, there are character data. As image data with high print ratios, there are picture data.

The ink quantity analyzer 13*b* has a calculated data of print ratio substituted in a prescribed expression for calculation to convert into an ink discharge amount, for each ink color (C, K, M, Y).

In this embodiment, the line inkjet head 20 or 20' has a resolution of 300 dpi×300 dpi for instance, and a preset ink quantity per one dot as 30 pl (pico-lit.) for instance. Accordingly, for a printing with a print ratio of 50% over an entirety of a recording sheet PA of an A4 size (210 mm×297 mm) for instance, it has 0.13 ml {=(30 pl×300 dpi×300 dpi×210 mm/25.4 inch×297 mm/25.4 inch)×50%} as a quantity of ink propelled onto the A4 size print sheet PA.

Moreover, assuming 0.13 ml as a quantity of ink to be propelled onto one A4 size print sheet PA for instance, it has 13 ml (=0.13 ml×20 sheets×5 print sets) as a quantity of ink propelled every ink color onto 20 print sheets PA of A4 size times five print sets.

The ink quantity analyzer 13*b* is thus adapted for use of information on a print job or print jobs pertaining to a print data, to calculate for each ink color an ink quantity V necessitated for printing the print data, by expressions, such that:

Ink quantity per one recording sheet=ink quantity per one dot times total dot number per one recording sheet commensurate with recording sheet size times print ratio . . . (1); and Necessary ink quantity for printing the print data=the ink quantity per one recording sheet times recording sheet number times recording print set number . . . (2).

Even for line inkjet heads 20 or 20' different in specifications for resolution or such, there is possibility of calculating an ink quantity V necessitated for printing a print data in a similar calculation method.

Then, comparison is made between a quantity V (FIG. 14) of ink the ink quantity analyzer 13*b* has calculated as necessary for printing a print data, and a quantity Vp (FIG. 14) of ink in the common ink supply chamber 23 as measured by the ink quantity detector 33 provided at the common ink supply chamber 23 in the line inkjet head 20 or 20', as will be described later on.

As a result, if it is concluded that the common ink supply chamber 23 of the line inkjet head 20 or 20' has therein a quantity V of ink necessitated for printing the print data (i.e. if V≦Vp), then the controller 13 gives commands to stop circulation of ink, and have the intra-head ink temperature controller 30 or 30' control the ink temperature. Unless the common ink supply chamber 23 has therein a quantity V of ink necessitated for printing the print data (i.e. if V>Vp), the controller 13 gives commands to execute circulation of ink, and have the intra-ink circulation route ink temperature controller 70 control the ink temperature.

Figure 13:
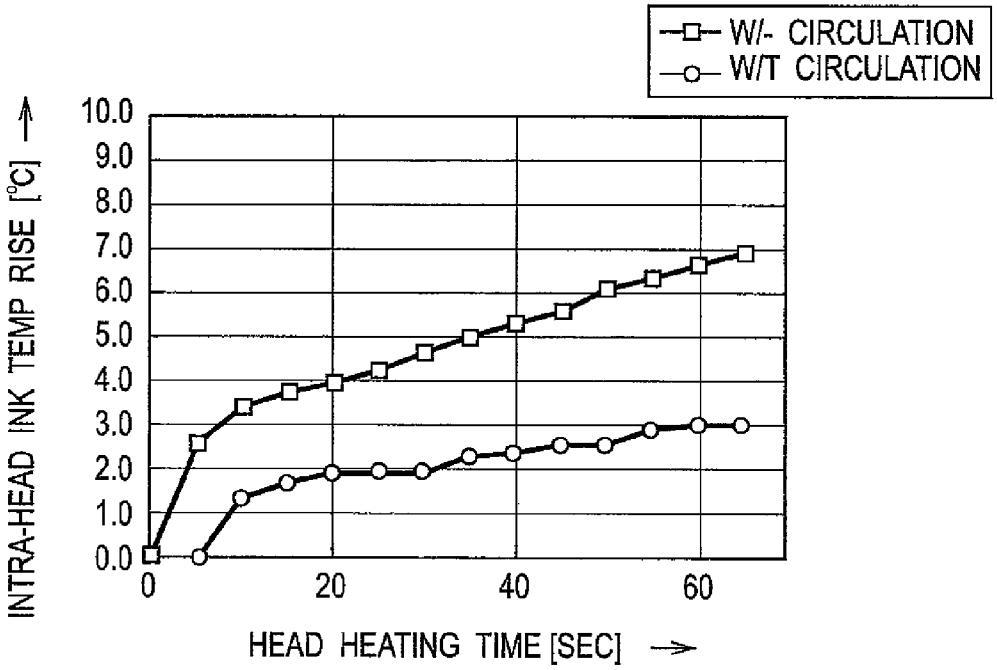
FIG. 13 is a graph for comparison between a heating of ink with circulation of ink and a heating of ink without circulation of ink in the line inkjet head of the inkjet printer according to the third embodiment.

This is because of a temperature rise of ink turned out after experiments, to be different as shown in FIG. 13 in variations along lapse of a head heating time, between presence and absence of ink circulation in courses of ink heating in each of the line inkjet heads 20 and 20', that is, in both the line inkjet head 20 shown in FIG. 11 that employs the first heater 32 provided at the common ink supply chamber 23 for heating ink in the head 20, and the line inkjet head 20' shown in FIG. 12 that employs pre-cursor motions for heating ink in the head blocks 22.

FIG. 13 plots in a graph tow ink-heating characteristic curves of the line inkjet head 20' using pre-cursor motions. The axis of abscissas represents a head heating time [sec], and the axis of ordinate represents a temperature rise [° C.] of ink in the head. White circles indicate plots of data under circulation of ink (w/-circulation) showing a temperature rise of ink in the head 20' that was approximately 3° C. with lapse of a head heating time of 60 seconds. White squares indicate plots of data without circulation of ink (w/t circulation) showing a temperature rise of ink in the head 20' that was approximately 6.7° C. with lapse of a head heating time of 60 seconds.

Also for the line inkjet head 20 using the first heater 32 for heating ink therein, there were ink-heating characteristics observed with and without circulation of ink, substantially similar to those in FIG. 13.

Accordingly, it has appeared that heating ink in head 20 or 20' without circulation of ink can raise the ink temperature faster to control to a target ink temperature TM with a reduced time than heating ink in head 20 or 20' in combination with circulation of ink.

With this in view, in the present embodiment, the inkjet printer 10 is adapted to control an ink temperature of ink in use in consideration of a quantity V of ink necessitated for printing a print data, and circulation of ink to be made or not, to implement a basic control of inkjet printer shown in FIG. 14, which will be described with reference to FIGS. 10 to 12 and FIGS. 14 to 18.

Figure 14:
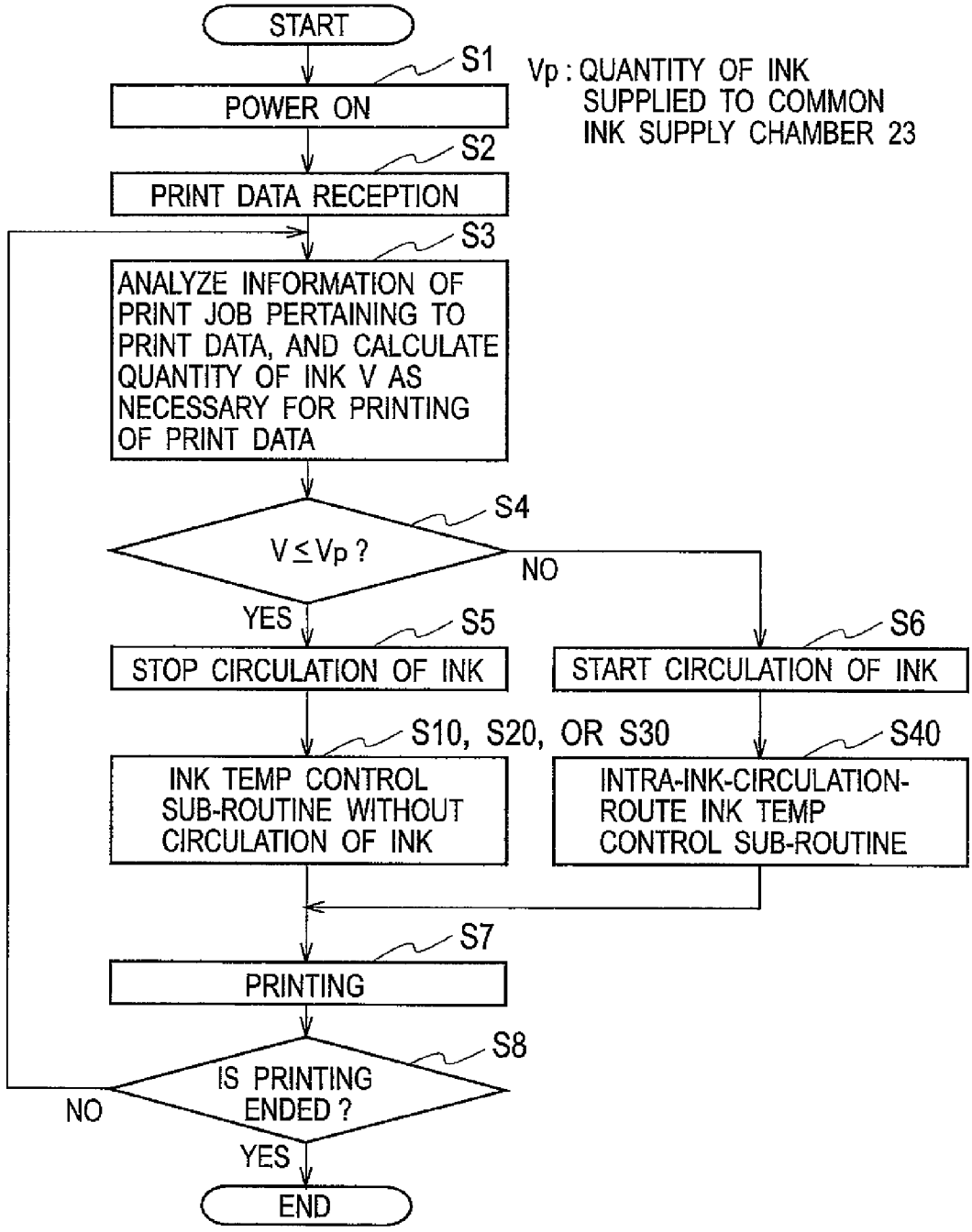
FIG. 14 is a flowchart of control actions for operations of the inkjet printer according to the third embodiment.

As shown by a flowchart in FIG. 14, at a start of the basic control of inkjet printer 10, the control flow goes to a step S1 to turn the power supply 11 on to activate the controller 13.

Next, at a step S2, there is a set of print data transmitted from the personal computer PC through LAN cable or the like, received through the interface 12, and temporarily stored in the data storing processor 13*a*.

Next, at a step S3, the controller 13 reads print data in the data storing processor 13*a*, and gives a command to the incorporated ink quantity analyzer 13*b* to analyze information on a print job pertaining to the print data, to calculate a quantity V of ink necessitated for printing the print data by using expressions (1) and (2) described, before a start of printing of the print data.

Next, at a step S4, the ink quantity analyzer 13*b* employs assistance of the operator 13*c* in the controller 13 for comparison between: a quantity V of ink necessitated for printing the print data acquired at the step S3; and a quantity Vp of ink supplied inside the common ink supply chamber 23 as measured by the ink quantity detector 33 provided at the common ink supply chamber 23 in the line inkjet head 20 or 20'.

It is noted that there may be an inner volume of the common ink supply chamber 23 stored in the RAM 13*e* in the controller 13, to read as an ink quantity Vp in the common ink supply chamber 23 in a state of the common ink supply chamber 23 filled with ink before a start of printing, If the quantity Vp of ink in the common ink supply chamber 23 is greater than the quantity V of ink necessitated for printing the print data (Yes at the step S4), then the control flow goes to a step S5 for the controller 13 to give a command to stop circulation of ink.

At the step S5, the controller 13 works to keep the pump 60 in the ink circulation route IC2 from operating, and turn the first and second electromagnetic valves 54 and 58 off, thus preventing ink from circulating in the ink circulation route IC2, so there is a quantity (Vp) of ink secured in the common ink supply chamber 23 of the line inkjet head 20 or 20', to be sufficient for printing the print data.

Past the step S5 stopping circulation of ink, the control flow enters an interrupting one of later-described three circulationless ink temperature control sub-routines S10, S20, and S30 stored in the ROM 13*d* of the controller 13, each as a program to control the ink temperature of ink in the line inkjet head 20 or 20' to a target ink temperature TM within an applicable range of the ink. In due course, the control flow exits the program, and afterward it goes to a step S7 for the head blocks 22 in the line inkjet head 20 or 20' to record a print data on a recording sheet PA.

Then, the control flow goes from the step S7 to a step S8 to interrogate if the printing is to be ended there. If the printing is to be ended (Yes at the step S8), the control flow goes to an end. If the printing is to be continued (No at the step S8), the control flow goes again to the step S3 to repeat the steps S3 to S8 till the printing goes to an end.

This print control includes flows of control actions (steps S1 to one of S10, S20, S30, and S40) between power-on and execution of a printing, which are referred herein to as a pretreatment for the printing.

In the line inkjet head 20 or 20', if the common ink supply chamber 23 has a quantity V of ink secured therein as necessary for printing a print data, this print data is printable therewith, so circulation of ink is stopped, and residual ink in the line inlet head 20 or 20' is heated to raise the ink temperature faster than would be with circulation of ink, as discussed in conjunction with FIG. 13, thus allowing for a reduced warm-up time for ink temperature control relative to conventional inkjet printers, while eliminating the need of controlling ink temperature of entire ink in the inkjet printer 10, allowing for an enhanced energy saving over the inkjet printer 10.

There will be description of control actions in an interrupting one of circulation-less ink temperature control sub-routines S10, S20, and S30, as it is referred in sequence, where ink is kept from circulating in the ink circulation route IC2, and the line inkjet head 20 or 20' is not driven into any printing state, so ink in the line inkjet head 20 or 20' is assumed to have an ink temperature under an upper limit TH of ink temperature within a specified ink applicable range.

Figure 15:
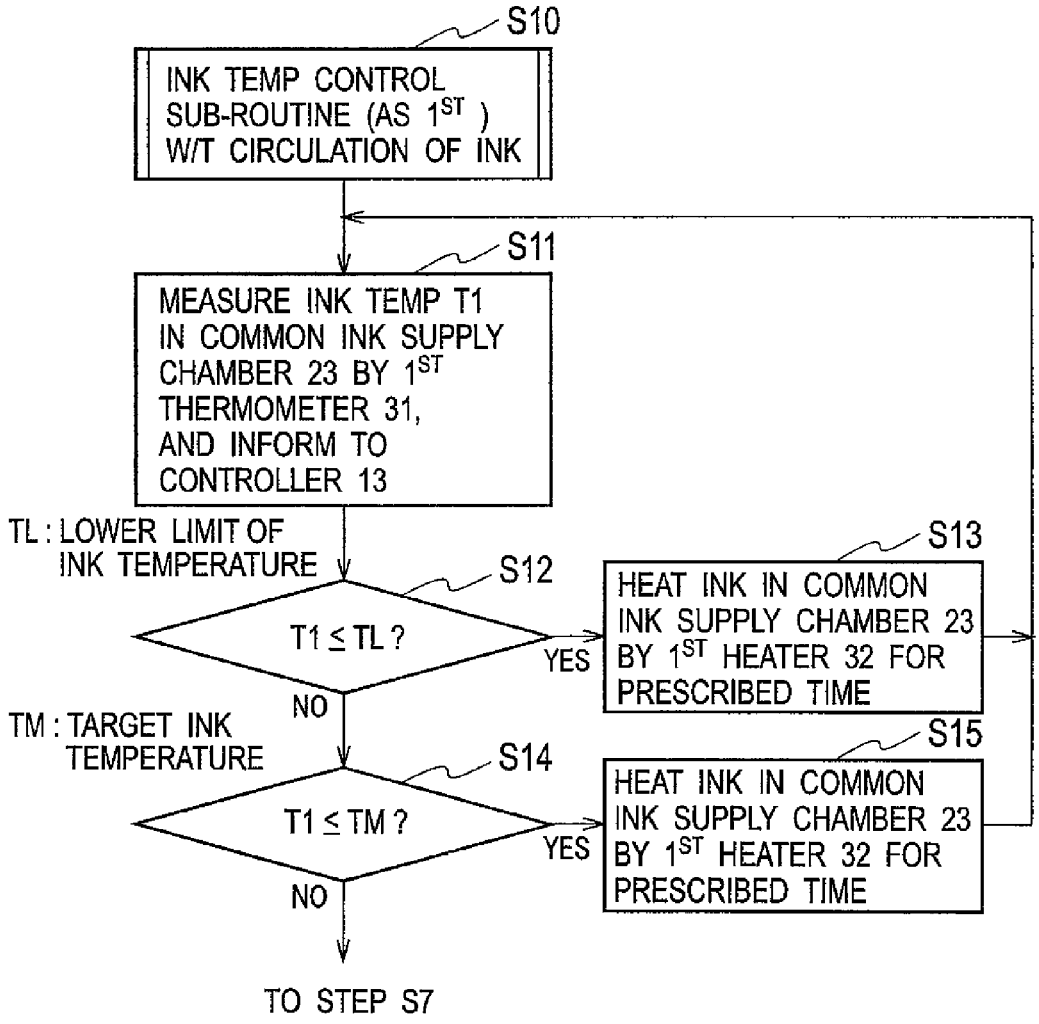
FIG. 15 is a flowchart of control actions in an ink temperature control sub-routine (as a first) without circulation of ink in the flowchart of FIG. 14.

FIG. 15 is a flowchart of control actions in the circulation-less ink temperature control sub-routine S10 (as a first referred one), which is applicable to a process of employing the line inkjet head 20 illustrated in FIG. 11, for using the first thermometer 31 and the first heater 32 provided at the common ink supply chamber 23 of the line inkjet head 20, to measure an ink temperature T1 of ink in the common ink supply chamber 23 and to heat this ink, respectively.

In the sub-routine S10, the control flow first goes to a step S11 to measure an ink temperature T1 of ink in the common ink supply chamber 23 of the line inkjet head 20 using the first thermometer 31 provided at the common ink supply chamber 23, and inform a result of measurement (T1) to the controller 13.

Next, at a step S12, the controller 13 employs assistance of the operator 13*c* for comparison between a measure of ink temperature T1 at the first thermometer 31 and a lower limit TL, of ink temperature stored in the RAM 13*e* of the controller 13, to determine whether or not the ink temperature T1 is lower than the lower limit TL of ink temperature.

If the ink temperature T1 is lower than the lower limit TL of ink temperature (Yes at the step S12), then the control flow goes to a step S13 for the first heater 32 provided at the common ink supply chamber 23 of the line inkjet head 20 to heat ink in the common ink supply chamber 23 for a prescribed time. Afterward, it again goes to the step S11, to repeat this step S11.

On the other hand, if the ink temperature T1 is equal to or higher than the lower limit TL of ink temperature (No at the step S12), then the control flow goes to a step S14. At this step S14, the controller 13 employs assistance of the operator 13*c* for comparison between the measure of ink temperature T1 at the first thermometer 31 and a target ink temperature TM stored in the RAM 13*e* of the controller 13, to determine whether or not the ink temperature T1 is lower than the target ink temperature TM.

If the ink temperature T1 is lower than the target ink temperature TM (Yes at the step S14), then the control flow goes to a step S15 for the first heater 32 to heat ink in the common ink supply chamber 23 for a prescribed time, like the step S13. Afterward, it again goes to the step S11, to repeat this step S11. On the other hand, if the ink temperature T1 is equal to or higher than the target ink temperature TM (No at the step S14), then the ink temperature T1 should be optimal for use, so the control flow goes to the step S7 in FIG. 14, to make a print.

In the sub-routine S10, the target ink temperature TM is set higher than the lower limit TL of ink temperature, so the steps S12 and S13 may be omitted.

Figure 16:
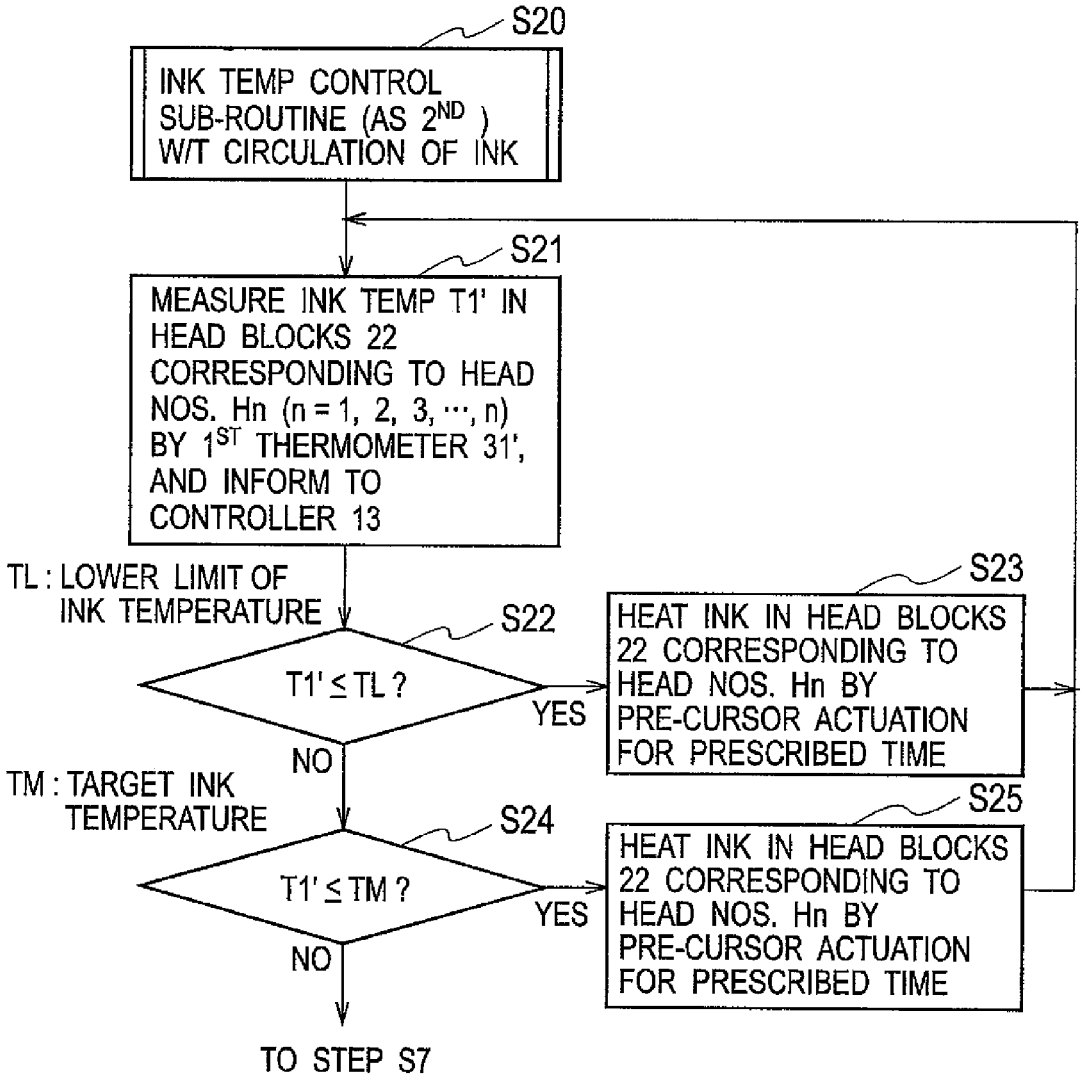
FIG. 16 is a flowchart of control actions in an ink temperature control sub-routine (as a second) without circulation of ink in the flowchart of FIG. 14.

FIG. 16 is a flowchart of control actions in the circulation-less ink temperature control sub-routine S20 (as a second referred one), which is applicable to a process of employing the line inkjet head 20' illustrated in FIG. 12, for using first thermometers 31 one-to-one provided at the head blocks 22, to measure an ink temperature T1 of ink in each head block 22, heating this ink by pre-cursor.

In the sub-routine S20, the control flow first goes to a step S21 to measure an ink temperature T1' of ink in a respective one of the head blocks 22 designated by a corresponding current head number Hn (n=1, 2, 3, . . . , 6) in the line inkjet head 20', using the first thermometer 31' provided at the respective head block 22, and inform a result of measurement (T1') to the controller 13.

Next, at a step S22, the controller 13 employs assistance of the operator 13*c* for comparison between a measure of ink temperature T1' at the first thermometer 31' at the respective head block 22 and a lower limit TL of ink temperature stored in the RAM 13*e* of the controller 13, to determine whether or not the ink temperature T1' is lower than the lower limit TL of ink temperature.

If the ink temperature T1' is lower than the lower limit TL of ink temperature (Yes at the step S22), then the control flow goes to a step S23 to heat ink in the head block 22 corresponding to the current head number Hn by pre-cursor motions therein for a prescribed time. Afterward, the control flow again goes to the step S21, to repeat this step S21 for a subsequent head number $H_{n+1}$.

On the other hand, if the ink temperature T1' is equal to or higher than the lower limit TL of ink temperature (No at the step S22), then the control flow goes to a step S24. At this step S24, the controller 13 employs assistance of the operator 13*c* for comparison between the measure of ink temperature T1' at the first thermometer 31 at the respective head block 22 and a target ink temperature TM stored in the RAM 13*e* of the controller 13, to determine whether or not the ink temperature T1' is lower than the target ink temperature TM.

If the ink temperature T1' is lower than the target ink temperature TM (Yes at the step S24), then the control flow goes to a step S25 to heat ink in the head block 22 corresponding to the current head number Hn by pre-cursor motions therein for a prescribed time. Afterward, the control flow again goes to the step S21, to repeat this step S21 for a subsequent head number $H_{n+1}$. On the other hand, if the ink temperature T1' of each head block 22 is equal to or higher than the target ink temperature TM (No at the step S24), then the respective ink temperatures T1' should be optimal for use, so the control flow goes to the step S7 in FIG. 14, to make a print.

In the sub-routine S20 also, the target ink temperature TM is set higher than the lower limit TL of ink temperature, so the steps S22 and S23 may be omitted.

Figure 17:
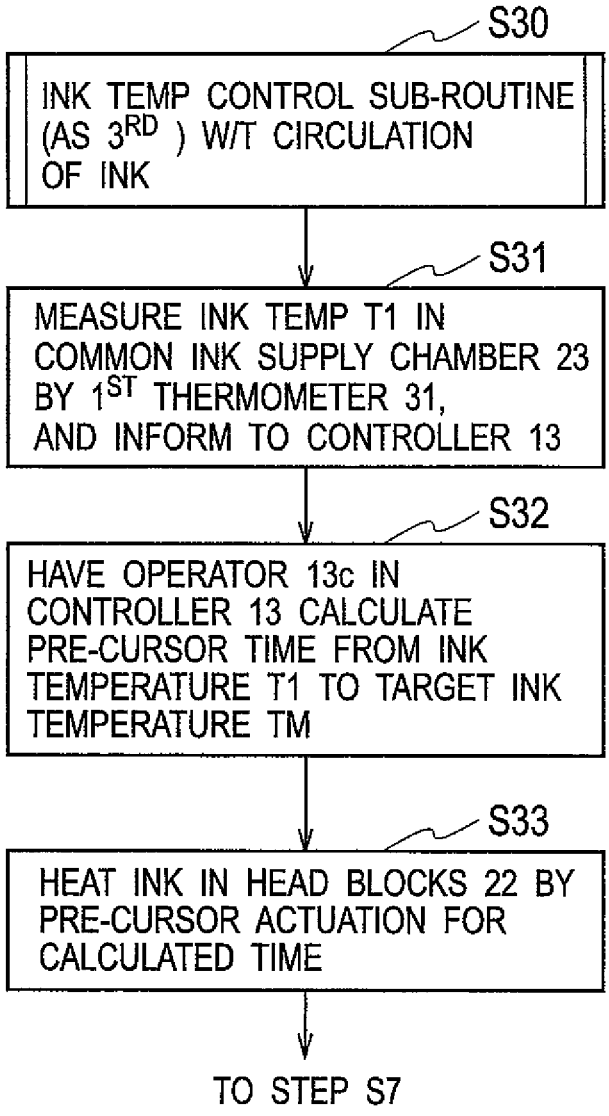
FIG. 17 is a flowchart of control actions in an ink temperature control sub-routine (as a third) without circulation of ink in the flowchart of FIG. 14.

FIG. 17 is a flowchart of control actions in the circulation-less ink temperature control sub-routine S30 (as a third referred one), which is applicable to a process of employing the line inkjet head 20 illustrated in FIG. 11, for using the first thermometer 31 provided at the common ink supply chamber 23, to measure an ink temperature T1 of ink in the common ink supply chamber 23, and heating this ink by pre-cursor motions for a pre-cursor time predicted depending on the ink temperature T1, as necessary to attain a target ink temperature TM.

In the sub-routine S30, the control flow first goes to a step S31 to measure an ink temperature T1 of ink in the common ink supply chamber 23 of the line inkjet head 20 using the first thermometer 31 provided at the common ink supply chamber 23, and inform a result of measurement (T1) to the controller 13.

Next, at a step S32, the controller 13 employs assistance of the operator 13*c* for calculations to predict a pre-cursor time depending on the ink temperature T1, as necessary to attain a target ink temperature TM by pre-cursor motions. For this prediction, there may be use of an inclination of the characteristic curve plotted in FIG. 13 as data under a condition without circulation. Instead of calculation, there may be use of a table in the controller 13 to simply read from a listing therein a pre-cursor time necessitated for a temperature rise from the ink temperature T1 to the target ink temperature TM.

Next, at a step S33, the head blocks 22 are controlled to heat ink therein by pre-cursor motions over the predicted pre-cursor time, so heated ink has optimal temperatures for use. Then, the control flow goes to the step S7 in FIG. 14, to make a print.

Referring again to FIG. 14, at the step S4, if the quantity Vp of ink in the common ink supply chamber 23 of the line inkjet head 20 or 20' is smaller than the quantity V of ink necessitated for printing the print data (No at the step S4), then the control flow goes to a step S6 for the controller 13 to give a command to start circulation of ink.

At the step S6, the controller 13 works to operate the pump 60 in the ink circulation route IC2, turning the first and second electromagnetic valves 54 and 58 on to circulate ink in the ink circulation route IC2, supplying the common ink supply chamber 23 with ink.

Past the step S6 starting circulation of ink, the control flow enters an interrupting intra-ink circulation route ink temperature control sub-routine S40 that has been stored in the ROM 13*d* of the controller 13 as a program to control temperatures of ink in the line inkjet head 20 or 20' to a target ink temperature TM setup within a specified ink applicable range. In due course, the control flow exits the sub-routine S40, and goes to the step S7 to drive the head blocks 22 in the line inkjet head 20 or 20' to record a print data on a recording sheet PA.

As described, the control flow goes from the step S7 to the step S8 to interrogate if the printing is to be ended there. If the printing is to be ended (Yes at the step S8), the control flow goes to an end. If the printing is to be continued (No at the step S8), the control flow goes again to the step S3 to repeat the steps S3 to S8 till the printing goes to an end.

In the line inkjet head 20 or 20', if the common ink supply chamber 23 fails to have a quantity V of ink secured therein as necessary for printing a print data, there is the need of ink circulating to supply ink to the common ink supply chamber 23 of the line inkjet head 20 or 20'. In this case, ink may be heated simply by the second heater 72 in the ink circulation route IC2 or by combination of the first heater in the head 20 or 20' and the second heater 72 in the ink circulation route IC2, having the ink temperature rise with a slower rate than would be without circulation of ink, as discussed in conjunction with FIG. 13, thus resulting in an extended warm-up time in control of ink temperature.

Figure 18:
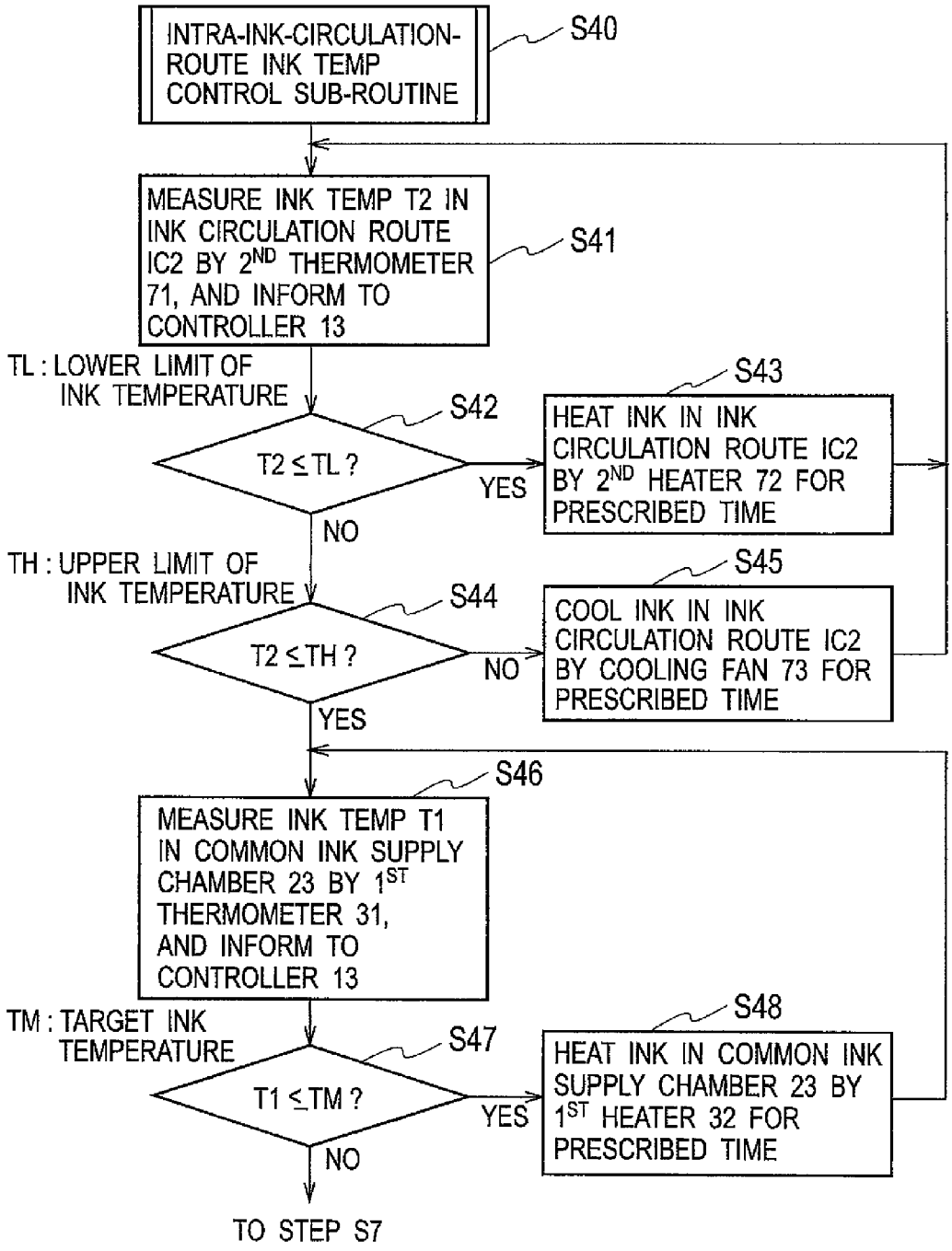
FIG. 18 is a flowchart of control actions in an intra-ink-circulation-route ink temperature control sub-routine in the flowchart of FIG. 14.

FIG. 18 is a flowchart of control actions in the intra-ink circulation route ink temperature control sub-routine S40 assumed as programmed for an exemplary process of heating ink by combination of the first heater 32 in the head 20 or 20' and the second heater 72 in the ink circulation route IC2, while it may well be programmed otherwise, for instance, for a process of heating ink simply by the second heater 72 in the ink circulation route IC2.

In the sub-routine S40, the control flow first goes to a step S41 to measure an ink temperature T2 of ink in the ink circulation route IC2 using the second thermometer 71 provided in the ink circulation route IC2, and inform a result of measurement (12) to the controller 13.

Next, at a step S42, the controller 13 employs assistance of the operator 13*c* for comparison between a measure of ink temperature T2 at the second thermometer 71 and a lower limit TL of ink temperature stored in the RAM 13*e* of the controller 13, to determine whether or not the ink temperature T2 is lower than the lower limit TL of ink temperature.

If the ink temperature T2 is lower than the lower limit TL of ink temperature (Yes at the step S22), then the control flow goes to a step S43 for the second heater 72 provided in the ink circulation route IC2 to heat ink in the ink circulation route IC2 for a prescribed time. Afterward, it again goes to the step S41, to repeat this step S41.

On the other hand, if the ink temperature T2 is equal to or higher than the lower limit TL of ink temperature (No at the step S42), then the control flow goes to a step S44. At this step S44, the controller 13 employs assistance of the operator 13*c* for comparison between the measure of ink temperature T2 at the second thermometer 71 and an upper limit TH of ink temperature stored in the RAM 13*e* of the controller 13, to determine whether or not the ink temperature T2 is lower than the upper limit TH of ink temperature.

If the ink temperature T2 is equal to or higher than the upper limit TH of ink temperature (No at the step S44), then the control flow goes to a step S45 to cool ink in the ink circulation route IC2 by the cooling fan 73 installed on the ink circulation route IC2. Afterward, it again goes to the step S41, to repeat this step S41.

On the other hand, if the ink temperature T2 is lower than the higher limit TH of ink temperature (Yes at the step S44), then it so follows that (lower limit TL of ink temperature)≦(ink temperature T2 of ink in ink circulation route IC2)<(higher limit TH of ink temperature), which means the ink temperature T2 resides within the ink applicable range.

Then, in use of the line inkjet head 20, the control flow first goes to a step S46 to measure an ink temperature T1 of ink in the common ink supply chamber 23 using the first thermometer 31 provided at the common ink supply chamber 23, and inform a result of measurement (T1) to the controller 13.

Next, at a step S47, the controller 13 employs assistance of the operator 13*c* for comparison between a measure of ink temperature T1 at the first thermometer 31 and a target ink temperature TM stored in the RAM 13*e* of the controller 13, to determine whether or not the ink temperature T1 is lower than the target ink temperature TM.

If the ink temperature T1 is lower than the target ink temperature TM (Yes at the step S47), then the control flow goes to a step S48 for the first heater 32 provided at the common ink supply chamber 23 to heat ink in the common ink supply chamber 23 for a prescribed time. Afterward, it again goes to the step S46, to repeat this step S46. On the other hand, if the ink temperature T1 is equal to or higher than the target ink temperature TM (No at the step S47), then the ink temperature T1 should be optimal for use, so the control flow goes to the step S7 in FIG. 14, to make a print.

For use of the line inkjet head 20', the steps S46 to S48 may be changed for use of pre-cursor motions to control temperatures of ink to the target ink temperature TM, or for temperature control of ink in the ink circulation route IC2 to the target ink temperature TM.

Fourth Embodiment

Figure 19:
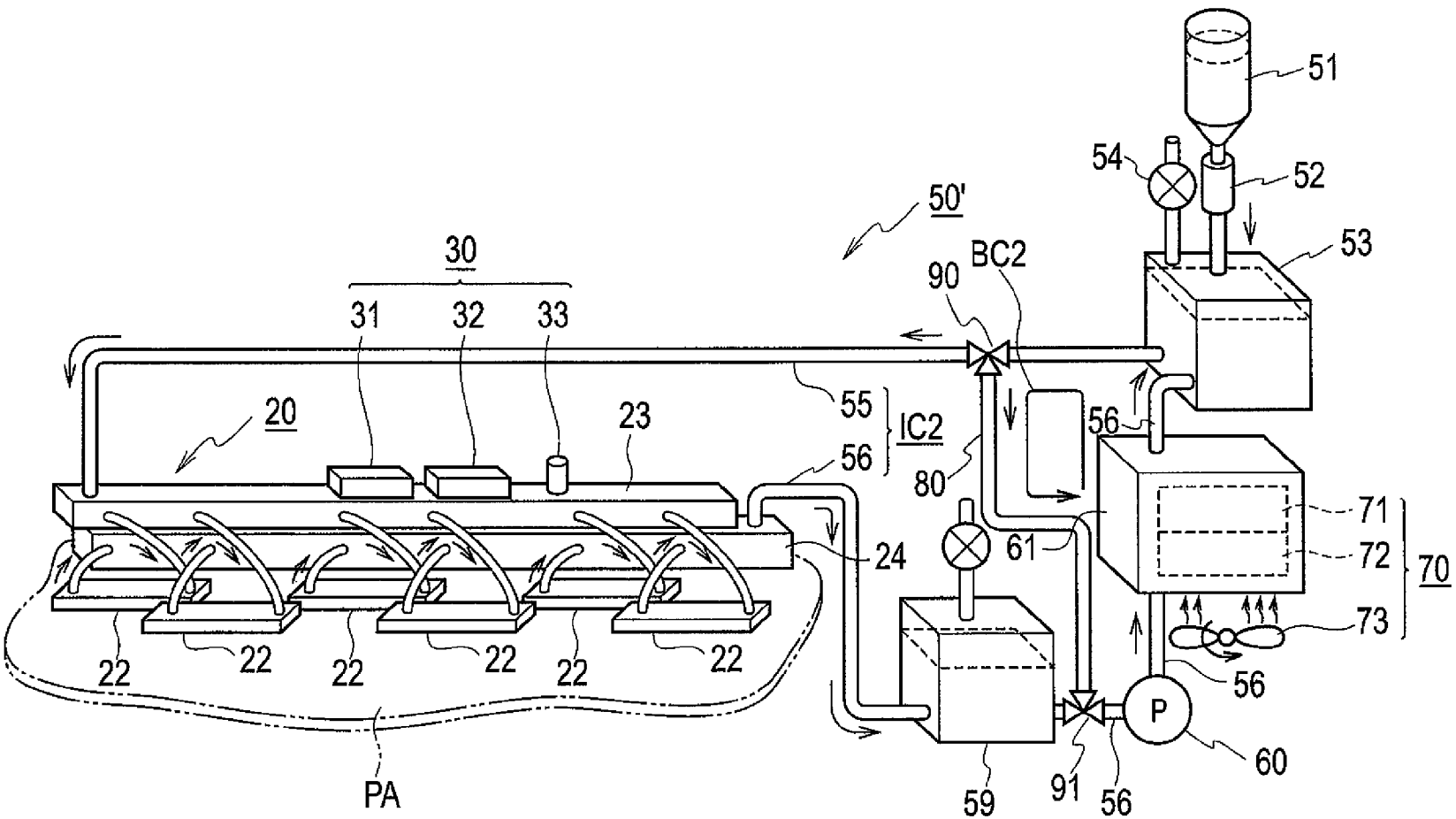
FIG. 19 is a schematic perspective view of combination of an inkjet head and a bypass circulation route of an inkjet printer according to a fourth embodiment of the present invention.

Description is now made of a fourth embodiment of the present invention, with reference to associated drawings. FIG. 19 shows combination of a line inkjet head 20 and a bypass circulation route BC2 of an inkjet printer 10*a* (see FIG. 10) according to the fourth embodiment. This inkjet printer 10*a* is a modification of the inkjet printer 10 according to the third embodiment, in which the ink circulation system 50 (FIG. 11) is modified with a bypass route 80 arranged as illustrated in FIG. 19, thereby constituting an ink circulation system 50'. Accordingly, it includes a controller 13 (see FIG. 10) adapted for different methods of print control, while other constituent elements as well as functional actions are substantially similar, and redundant description will be omitted.

As shown in FIG. 19, the bypass route 80 is provided as a bypass to the line inkjet head 20 on the ink circulation route IC2 in the third embodiment, in the form of a direct route for interconnection between a route section 55 that interconnects the line inkjet head 20 with an upper ink tank 53, and a route section (part of 56) that interconnects a lower ink tank 59 with a second heater 72 (as part of an intra-ink circulation route ink temperature controller 70). The ink circulation route IC2 is configured to circulate ink through the upper ink tank 53, the line inkjet head 20, the lower ink tank 59, a pump 60, and the intra-ink circulation route ink temperature controller 70 to come round to the upper ink tank 53, whereto provided with the bypass route 80, there is a bypass circulation route BC2 configured for circulating ink through the upper ink tank 53, the pump 60, and the intra-ink circulation route ink temperature controller 70 to come round to the upper ink tank 53, bypassing the line inkjet head 20 in the ink circulation route IC2.

In the flowchart shown in FIG. 14, for a quantity Vp of ink in the common ink supply chamber 23 more than a quantity V of ink necessitated to print a print data (No at the step S4), ink is circulated in the ink circulation route IC2, and for else than that (Yes at the step S4), ink circulation is stopped. This is because of an amount of warmed ink to be kept from flowing out of the common ink supply chamber 23 by circulation of ink. However, instead, in course of heating ink by the first heater 32 or pre-cursor motions at the line inkjet head 20 (in the sub-routine S10, S20, or S30), there is an upcoming issue of disabled warmup of entire ink in the ink circulation route IC2, with the need of reheating an entirety of ink circulation route IC2 when the common ink supply chamber 23 has become unable to supply sufficient ink.

Figure 20:
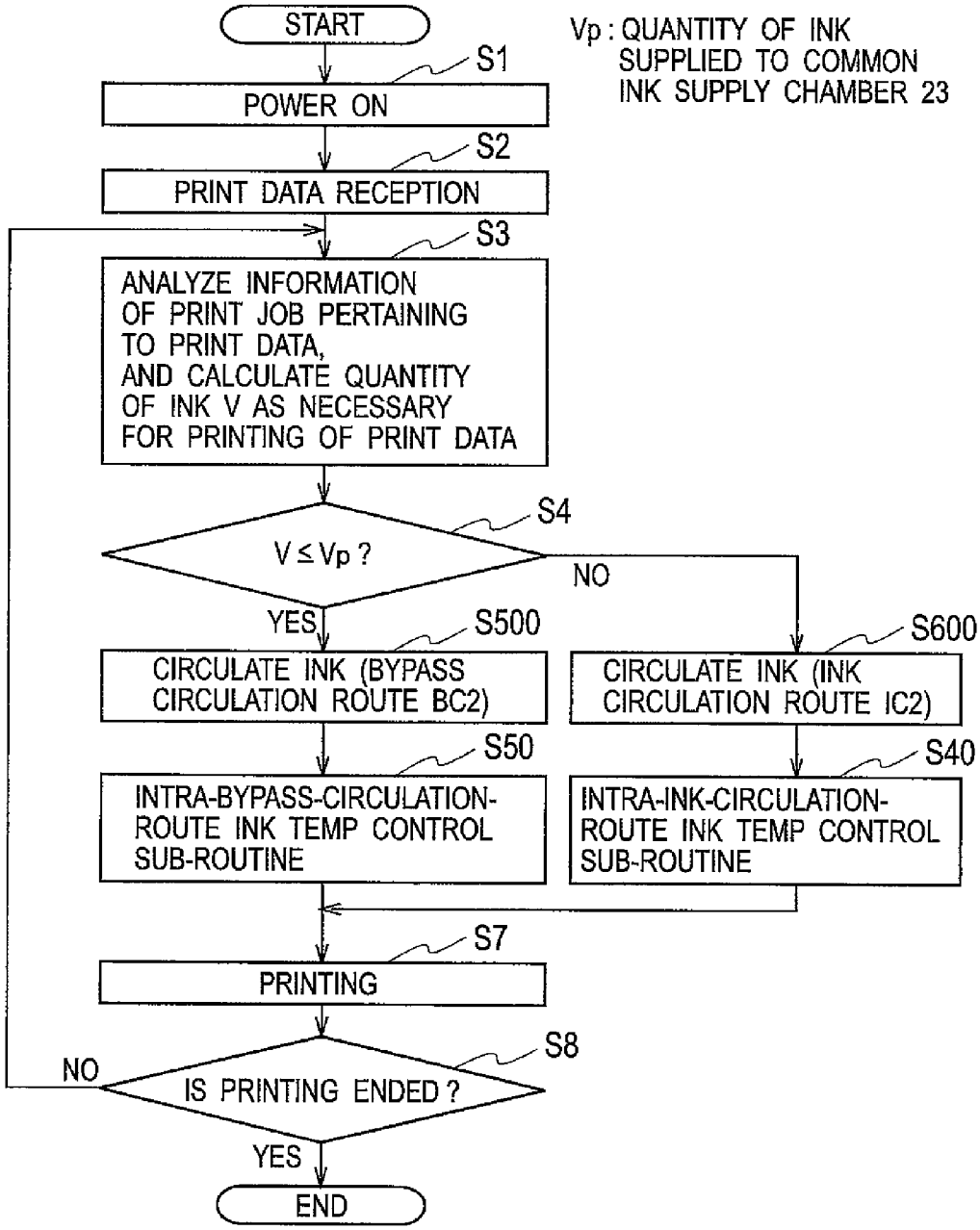
FIG. 20 is a flowchart of control actions for operations of the inkjet printer according to the fourth embodiment.

To this point, in the fourth embodiment, as shown by a flowchart in FIG. 20, the bypass circulation route BC2 is controlled to circulate ink, even in course of heating ink by the first heater 32 or pre-cursor motions at the line inkjet head 20, so ink in the upper ink tank 53 can be warmed efficiently in parallel with a printing, allowing for a more reduced time in transition from low-temperature states of ink such as upon power-on to optical-temperature states of ink.

The flowchart in FIG. 20 includes a sequence of steps S1 to S4, which is similar to the sequence of steps S1 to S4 in the flowchart of FIG. 14 in the third embodiment. Further, it includes steps S600 and S40, which also are similar to the steps S6 and S40 shown as control actions associated with the ink circulation route IC2 in the flowchart of FIG. 14 in the third embodiment. Accordingly, description will be made of a step S500 et seq.

In the flowchart of FIG. 20, if the quantity V of ink necessitated to print a print data is equal to or smaller than a quantity Vp of ink in the common ink supply chamber 23 (Yes at the step S4), then the control flow goes to the step S500 for the controller 13 to give a command to start circulation of ink along the bypass circulation route BC2.

That is, at the step S500, the controller 13 works to bring the pump 60 on the bypass circulation route BC2 into operation, and turn three-way valves 90 and 91 on, thus causing ink to circulate in the bypass circulation route BC2.

Past the step S500 starting circulation of ink, the control flow enters an intra-bypass circulation route ink temperature control sub-routine 550 stored in a ROM 13*d* of the controller 13 as a program for a later-described processing to control temperatures of ink in the line inkjet head 20 or 20' to a target ink temperature TM preset within a specified ink applicable range. In due course, the control flow exits the sub-routine S50, and goes to a step S7 to use head blocks 22 in the line inkjet head 20 or 20' to record a print data on a recording sheet PA.

Then, like the third embodiment, the control flow goes from the step S7 to a step S8 to interrogate if the printing is to be ended there. If the printing is to be ended (Yes at the step S8), the control flow goes to an end. If the printing is to be continued (No at the step S8), the control flow goes again to the step S3 to repeat the steps S3 to S8 till the printing goes to an end.

This print control includes flows of control actions (steps S1 to S50, and steps S1 to S40) between power-on and execution of a printing, which are referred herein to as a pretreatment for the printing.

Figure 21:
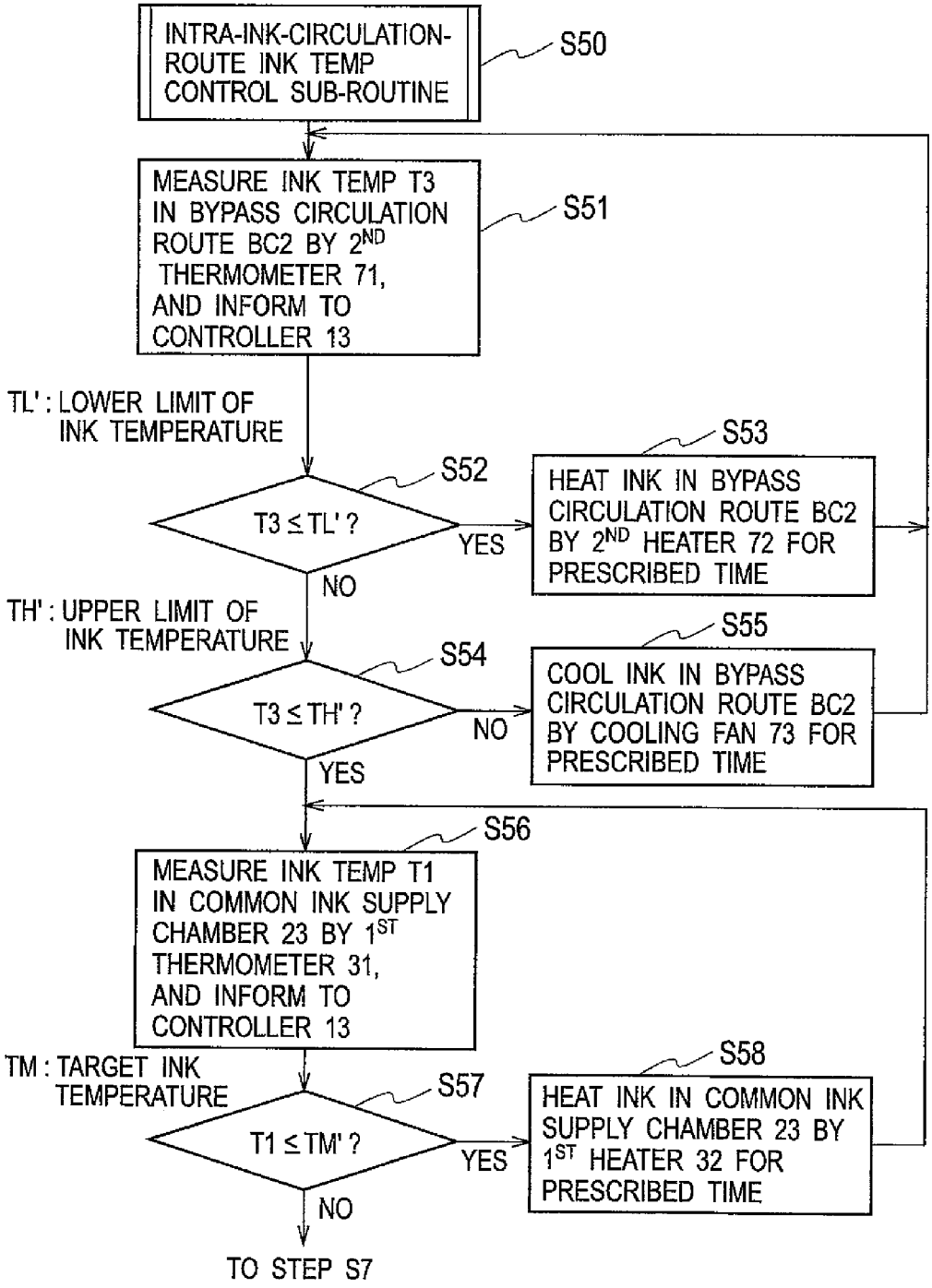
FIG. 21 is a flowchart of control actions in an intra-bypass-circulation-route ink temperature control sub-routine in the flowchart of FIG. 20.

FIG. 21 is a flowchart of control actions in the intra-bypass circulation route ink temperature control sub-routine S50 assumed as programmed for an exemplary process of heating ink by the second heater 72 on the bypass circulation route BC2.

In the sub-routine 550, the control flow first goes to a step S51 to measure an ink temperature T3 of ink in the bypass circulation route BC2 using the second thermometer 71 provided in the bypass circulation route BC2, and inform a result of measurement (T3) to the controller 13.

Next, at a step S52, the controller 13 employs assistance of the operator 13*c* for comparison between a measure of ink temperature T3 at the second thermometer 71 and a lower limit TL' of ink temperature stored in the RAM 13*e* of the controller 13, to determine whether or not the ink temperature T3 is lower than the lower limit TL' of ink temperature.

If the ink temperature 13 is lower than the lower limit TL' of ink temperature (Yes at the step S52), then the control flow goes to a step S53 for the second heater 72 provided in the bypass circulation route BC2 to heat ink in the bypass circulation route BC2 for a prescribed time. Afterward, it again goes to the step S51, to repeat this step S51.

On the other hand, if the ink temperature T3 is equal to or higher than the lower limit TL' of ink temperature (No at the step S52), then the control flow goes to a step S54. At this step S54, the controller 13 employs assistance of the operator 13*c* for comparison between the measure of ink temperature T3 at the second thermometer 71 and an upper limit TH' of ink temperature stored in the RAM 13*e* of the controller 13, to determine whether or not the ink temperature T3 is lower than the upper limit TH' of ink temperature.

If the ink temperature T3 is equal to or higher than the upper limit TH' of ink temperature (No at the step S54), then the control flow goes to a step S55 to cool ink in the bypass circulation route BC2 by a cooling fan 73 installed on the bypass circulation route BC2. Afterward, it again goes to the step S51, to repeat this step S51.

On the other hand, if the ink temperature T3 is lower than the higher limit TH' of ink temperature (Yes at the step S54), then it so follows that (lower limit TL' of ink temperature)≦

(ink temperature T3 of ink in bypass circulation route BC2) <(higher limit TH' of ink temperature), which means the ink temperature T3 resides within an ink applicable range.

Then, in use of the line inkjet head 20, the control flow first goes to a step S56 to measure an ink temperature T1 of ink in the common ink supply chamber 23 using a first thermometer 31 provided at the common ink supply chamber 23, and inform a result of measurement (T1) to the controller 13.

Next, at a step S57, the controller 13 employs assistance of the operator 13*c* for comparison between a measure of ink temperature T1 at a first thermometer 31 and a target ink temperature TM stored in the RAM 13*e* of the controller 13, to determine whether or not the ink temperature T1 is lower than the target ink temperature TM.

If the ink temperature T1 is lower than the target ink temperature TM (Yes at the step S57), then the control flow goes to a step S58 for a first heater 32 provided at the common ink supply chamber 23 to heat ink in the common ink supply chamber 23 for a prescribed lime. Afterward, it again goes to the step S56, to repeat this step S56. On the other hand, if the ink temperature T1 is equal to or higher than the target ink temperature TM (No at the step S57), then the ink temperature T1 should be optimal for use, so the control flow goes to the step S7 in FIG. 14, to make a print.

For use of a line inkjet head 20', the steps S 56 to S58 may be changed for use of pre-cursor motions to control temperatures of ink to the target ink temperature TM, or for temperature control of ink in the bypass circulation route BC2 to the target ink temperature TM.

According to the fourth embodiment, the inkjet printer 10*a* has a bypass circulation route BC2 provided to bypass the line inkjet head 20 on the ink circulation route IC2 in the third embodiment, as a direct route for interconnection between a route section (55) that interconnects the line inkjet head 20 with the upper ink tank 53, and a route section (intermediate part of 56) that interconnects the lower ink tank 59 with the second heater 72 in the intra-ink circulation route ink temperature controller 70. However, instead, there may be a bypass route otherwise provided to achieve like objective. For instance, there may be a bypass route provided to bypass the line inkjet head 20 on the ink circulation route IC2 in the third embodiment, as a direct route for interconnection between the route section (55) that interconnects the line inkjet head 20 with the upper ink tank 53, and a route section (upstream part of 56) that interconnects the line inkjet head 20 with the lower ink tank 59. In this case, the provision of bypass route constitutes a bypass circulation route for circulating ink through the upper ink tank 53, the lower ink tank 59, the pump 60, and the intra-ink circulation route ink temperature controller 70 to come round to the upper ink tank 53, bypassing the line inkjet head 20. This bypass circulation route is adapted for circulation of ink to thereby efficiently warm flux of ink in the lower ink tank 59 and the upper ink tank 53 in parallel with a printing, thus allowing for a still reduced time for transition to adequate temperature states of ink from a low ink-temperature state such as upon power-on. It however is noted that this configuration needs a negative pressure generator additionally installed on a route section interconnecting the line inkjet head 20 with one of paired three-way valves or a mute section interconnecting the line inkjet head 20 with the other three-way valve, for exertion of an adequate negative pressure to the line inkjet head 20.

Further, there may be a bypass route provided to bypass the line inkjet head 20 on the ink circulation route IC2 in the third embodiment, as a direct route for interconnection between the route section (upstream part of 56) that interconnects the line inkjet head 20 with the lower ink tank 59, and a route section (downstream part of 56) that interconnects the intra-ink circulation route ink temperature controller 70 with the upper ink tank 53. In this case, the provision of bypass route constitutes a bypass circulation route for circulating ink through the lower ink tank 59, the pump 60, and the intra-ink circulation route ink temperature controller 70 to come round to the lower ink tank 59, bypassing the line inkjet head 20. This bypass circulation route is adapted for circulation of ink to thereby efficiently warm flux of ink in the lower ink tank 59 and the upper ink tank 53 in parallel with a printing, thus allowing for a still reduced time for transition to adequate temperature states of ink from a low ink temperature state such upon power-on. It however is noted that this configuration needs a negative pressure generator additionally installed on a route section interconnecting the line inkjet head 20 with the upper ink tank 53, for exertion of an adequate negative pressure to the line inkjet head 20.

Figure 22:
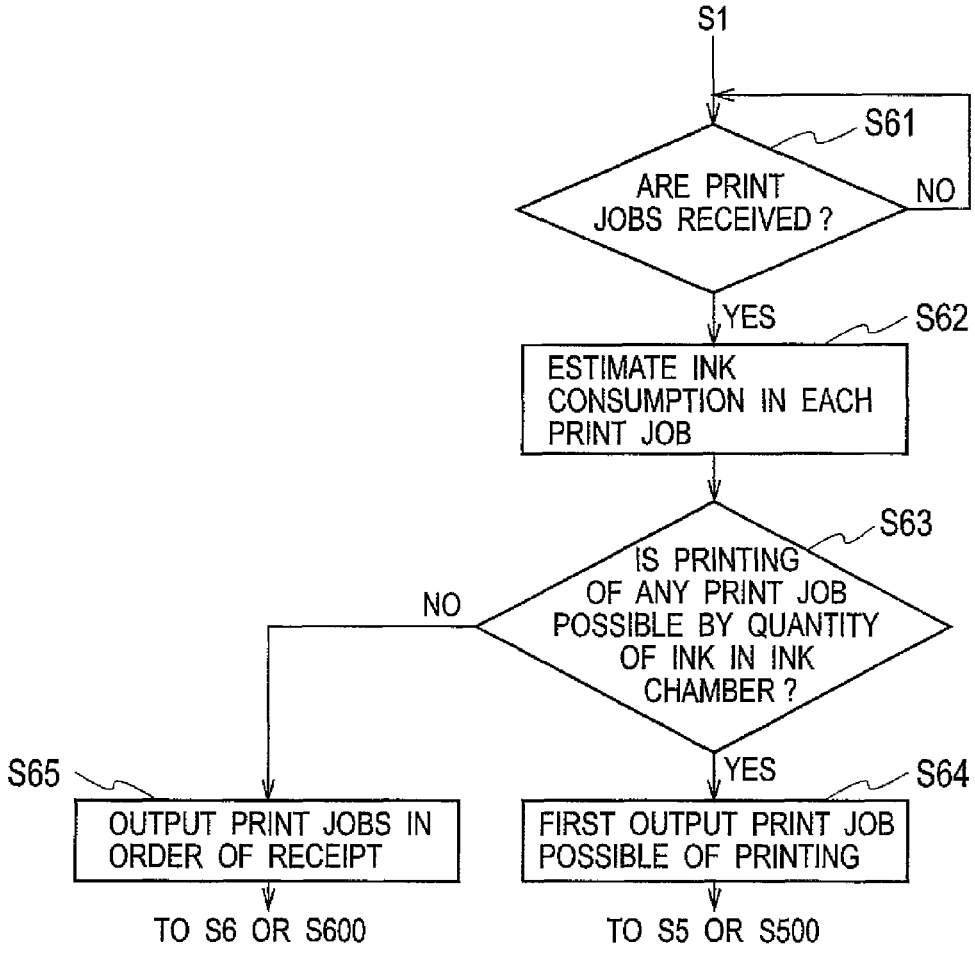
FIG. 22 is a flowchart of control actions for a printing to implement print jobs received upon power-on, in a form common to the inkjet printer according to the third embodiment and the inkjet printer according to the fourth embodiment.

Description is now made of a modified example of print control having a plurality of print jobs received upon power-on in either of the inkjet printers 10 and 10*a* according to the third and the fourth embodiment, respectively. FIG. 22 shows, in a flowchart, control actions for a printing to implement print jobs received upon power-on in either of the inkjet printers 10 and 10*a*. Past the step S1 for power-on, at a decision step S61 determining whether or not the inkjet printer 10 or 10*a* has received print jobs, if it has received print jobs (Yes at the step S61), then the control flow goes to a step S62, where the control 13 drives a power controller 13*f* to power on the line inkjet head 20, an intra-head ink temperature controller 30, a sheet transfer system 40, the ink circulation system 50 or 50', the intra-ink circulation route ink temperature controller 70, and the like to restart.

Further, it drives an ink quantity analyzer 13*b* to estimate a quantity of ink to be consumed for printing a respective received print job.

Then, at a step S63, collation is made of quantities of ink estimated to consume for printing the print jobs, with a quantity of ink stored in the common ink supply chamber 23 as detected by an ink quantity detector 33 of the intra-head ink temperature controller 30, to check for a print job printable by a quantity of ink in the common ink supply chamber 23, to determine if any.

As a result of determination, if there is any print job printable by a quantity of ink in the common ink supply chamber 23 (Yes at the step S63), then the control flow goes to a step S64 to output one or more sets of print data in sequence, with priority to a current printable print job, to proceed to the step S5 or S500 (pre-treatment for printing) in the third or fourth embodiment, respectively.

On the other hand, if there is no print job printable by a quantity of ink in the common ink supply chamber 23 (No at the step S63), the control flow goes to a step S65 to output sets of print data in the order of received print jobs, to proceed to the step S6 or S600 in the third or fourth embodiment, respectively.

Such a pretreatment affords an efficient printing of print jobs received upon power-on.

The above print control includes flows of control actions (steps S1 to one of S10, S20, S30, S40, and S50) between power-on and execution of a printing, which are referred herein to as a pretreatment for the printing.

The foregoing embodiments have been described as an example of inkjet printer using ink as a viscous fluid. Viscous fluid used may be a cream solder, adhesive, etc.

As will be seen from the foregoing description, according to an embodiment of the present invention, there is an inkjet printer adapted to work, with a measure of ink temperature under a prescribed criterion, for control actions to vibrate ink to raise temperatures of ink in ink chambers. Accordingly, it allows for a reduced time from an energy saving mode to a start of printing, in a low-temperature phase.

For a printing possible with a quantity of ink in ink chambers and/or a common ink supply chamber as an ink chamber, circulation of ink is kept inactive even after a measure of ink temperature under a prescribed criterion. Since ink circulation is inactive, temperature-raised ink is kept from running out along an ink circulation route, and stays within ink chambers. This permits temperatures of ink in ink chambers to rise up to an adequate temperature range faster than would be by combination of ink circulation and warm-up by heater. This allows for a reduced time from deactivation of energy saving mode to a start of printing in low-temperature situations.

Further, for a printing possible with a quantity of ink in an ink chamber and/or ink chambers, there is combination of ink vibrations and ink circulation by use of a bypass circulation route after a measure of ink temperature under a prescribed criterion. This can prevent the printing from suffering depletion of ink on the way, or from being made with low-temperature ink, in addition to the effect described.

According to an embodiment of the present invention, there is an inkjet printer adapted to work with a low-temperature state of ink, to control an ink temperature of ink in a print head for a prompt raise up to an ink applicable range, in consideration of an amount of print data to be printed, thus affording an efficient reduction of warm-up time in ink temperature control, with an eliminated need of controlling an ink temperature of entire ink in the inlet printer, allowing for an enhanced energy saving.

For residual quantities of ink meeting a criterion, circulation of ink is kept inactive to prevent temperature-raised ink from running out along an ink circulation route, so ink stays in an ink chamber or ink chambers. Accordingly, residual ink can be warmed up to an adequate temperature range faster than would be by combination of ink circulation and heating by heater, thus allowing for a reduced time from deactivation of energy saving mode to a start of printing, in a low-temperature phase.

Even in control for a residual quantity of ink meeting a criterion, there can be use of ink circulation in a bypass circulation route, to prevent a printing from suffering depletion of ink on the way, or from being made with low-temperature ink, in addition to the effects described.

According to an embodiment of the present invention, there is an inkjet printer adapted to work with print jobs received at least upon power-on or deactivation of energy saving mode, to process print data with priority to a print job printable with a quantity of ink in an ink chamber or ink chambers, thus allowing for an enhanced efficiency in printing in a low-temperature phase.

According to the present invention, there is an inlet printer provided with an ink circulation route allowing for a reduced time for transition of ink state to an optimal temperature state, such as those from a low temperature state upon a power-on or in a return from energy saving mode.

While preferred embodiments of the present invention have been described using specific terms, such description is for illustrative purposes, and it is to be understood that changes and variations may be made without departing from the spirit or scope of the following claims.

What is claimed is:

1. An inkjet printer comprising:

a print head configured with an ink chamber to store ink therein;

an ink propelling mechanism to propel ink out of the ink chamber;

a temperature sensor to measure an ink temperature in the ink chamber;

an ink circulation route configured with a route including the ink chamber;

a power controller configured to enter an energy saving mode which interrupts a circulation of ink and a temperature control of ink upon a waiting period exceeding a prescribed interval of time; and a print controller configured to deactivate the energy saving mode in response to the temperature sensor having a measure of ink temperature lower than a prescribed value, for a pre-treatment to have the ink propelling mechanism make ink vibrating actions within degrees not to cause ink to be propelled out of the ink chamber, until the ink temperature reaches or exceeds the prescribed value.

2. The inkjet printer according to claim 1, further comprising an ink quantity analyzer configured to analyze a quantity of ink necessitated for a printing of an input print data, wherein the print controller is adapted to have the ink quantity analyzer determine whether or not the printing is possible by a quantity of ink in the ink chamber, and if a determination is made that printing is possible with the quantity of ink in the chamber, to proceed for the pre-treatment to have the ink propelling mechanism make ink vibrating actions within degrees not to cause ink to be propelled out of the ink chamber, without circulation of ink in the ink circulation route, until the ink temperature reaches or exceeds the prescribed value.

3. The inkjet printer according to claim 2, wherein the print controller is adapted to work with received print jobs to proceed past the pre-treatment to implement the print jobs with a priority to a print job including print data for the printing the ink quantity analyzer has determined as being possible by the quantity of ink in the ink chamber.

4. The inkjet printer according to claim 1, further comprising:

an ink quantity analyzer configured to analyze a quantity of ink necessitated for a printing of an input print data, wherein the ink circulation route comprises a bypass circulation route configured to bypass the print head, and the print controller is adapted to have the ink quantity analyzer determine whether or not the printing is possible by a quantity of ink in the ink chamber, if a determination is made that printing is possible with the quantity of ink in the chamber, to proceed for circulation of ink through the bypass circulation route, and to have the ink propelling mechanism make ink vibrating actions within degrees not to cause ink to be propelled out of the ink chamber, until the ink temperature becomes the prescribed value or more.

5. The inkjet printer according to claim 4, wherein the print controller is adapted to work with received print jobs to proceed past the pre-treatment to implement the print jobs with a priority to a print job including print data for the printing the ink quantity analyzer has determined as being possible by the quantity of ink in the ink chamber.

6. An inkjet printer comprising:

a print head configured with an ink chamber to store ink therein;

an ink propelling mechanism to propel ink out of the ink chamber;

a temperature sensor to measure an ink temperature in the ink chamber;

an ink circulation route configured with a route including the ink chamber;

an ink quantity analyzer configured to analyze a quantity of ink necessitated for a printing of an input print data;

a power controller configured to enter an energy saving mode which interrupts a circulation of ink and a temperature control of ink upon a waiting period exceeding a prescribed interval of time; and a print controller configured to deactivate the energy saving mode in response to the ink quantity analyzer having analyzed an ink quantity as a prescribed value or less, for a pre-treatment to heat ink up to an applicable ink temperature as a measure of ink temperature at the temperature sensor.

7. The inkjet printer according to claim 6, wherein the ink circulation route comprises an intra-ink-circulation-route ink heater configured to heat ink in the ink circulation route, and a bypass circulation route configured to bypass the print head, and the print controller is adapted to work at least along deactivation of the energy saving mode or upon power-on, in response to the ink quantity analyzer having analyzed an ink quantity as the prescribed value or less, to proceed for circulation of ink through the bypass circulation route, and use of the intra-ink-circulation-route ink heater for the pre-treatment to heat ink in the bypass circulation route up to the applicable ink temperature.

8. The inkjet printer according to claim 6, wherein the print controller is adapted to proceed for the pre-treatment to heat ink, without circulation of ink in the ink circulation route, up to the applicable ink temperature as a measure of ink temperature at the temperature sensor.

9. The inkjet printer according to claim 6, wherein the ink quantity analyzer is adapted to have information of print job pertaining to the print data as a basis to analyze a total dot number per one recording sheet, a print ratio, a recording sheet number, and a print set number commensurately with a recording sheet size, for calculation of an ink quantity per one dot times the total dot number per one recording sheet times the print ratio times the recording sheet number times the print set number to determine the quantity of ink necessitated for the printing of the print data.

10. The inkjet printer according to claim 6, wherein the print controller is adapted to work with received print jobs to proceed past the pre-treatment to implement the print jobs with a priority to a print job including print data for the printing the ink quantity analyzer has determined as being possible by a quantity of ink in the ink chamber.

* * * * *